US006775847B2

(12) United States Patent
Terris et al.

(10) Patent No.: US 6,775,847 B2
(45) Date of Patent: Aug. 17, 2004

(54) GOLF GLOVE AND METHOD OF FORMING SAME

(75) Inventors: Rita Terris, Bellmore, NY (US); Christopher S. Terris, Bellmore, NY (US); Edward C. Meagher, Greenlawn, NY (US)

(73) Assignee: Applications Systems Technologies, Inc., Bellmore, NY (US)

( * ) Notice: Subject to any disclaimer, the term of this patent is extended or adjusted under 35 U.S.C. 154(b) by 0 days.

(21) Appl. No.: 09/961,762

(22) Filed: Sep. 24, 2001

(65) Prior Publication Data

US 2003/0106132 A1 Jun. 12, 2003

Related U.S. Application Data

(60) Provisional application No. 60/234,670, filed on Sep. 22, 2000, provisional application No. 60/255,937, filed on Dec. 15, 2000, provisional application No. 60/268,639, filed on Feb. 14, 2001, provisional application No. 60/305,116, filed on Jul. 13, 2001, and provisional application No. 60/305,115, filed on Jul. 13, 2001.

(51) Int. Cl.[7] ..... A41D 19/00
(52) U.S. Cl. ..... 2/161.1; 2/161.2
(58) Field of Search ..... 2/161.2, 161.1, 2/159, 16, 20, 161.6, 161.3, 161.8

(56) References Cited

U.S. PATENT DOCUMENTS

| | | | | |
|---|---|---|---|---|
| 3,255,462 | A | | 6/1966 | Antonious |
| 4,071,913 | A | | 2/1978 | Rector |
| 4,183,100 | A | | 1/1980 | De Marco |
| 4,416,026 | A | | 11/1983 | Smith |
| 4,531,241 | A | | 7/1985 | Berger |
| 4,561,122 | A | | 12/1985 | Stanley et al. |
| 4,624,016 | A | | 11/1986 | Luevano |
| 4,691,387 | A | | 9/1987 | Lopez |
| 4,700,405 | A | | 10/1987 | Sternberg |
| 4,701,963 | A | | 10/1987 | Overton |
| 4,748,690 | A | | 6/1988 | Webster |
| 4,945,571 | A | | 8/1990 | Calvert |
| D314,643 | S | | 2/1991 | Kotowski |
| 5,014,689 | A | | 5/1991 | Meunchen et al. |
| 5,218,719 | A | | 6/1993 | Johnson |
| 5,257,418 | A | | 11/1993 | Jaskiewicz |
| 5,285,529 | A | | 2/1994 | Arena |
| 5,330,249 | A | | 7/1994 | Weber et al. |
| 5,345,609 | A | | 9/1994 | Fabry et al. |
| 5,357,636 | A | | 10/1994 | Dresdner, Jr. et al. |
| 5,450,628 | A | | 9/1995 | Lowinger |
| 5,557,803 | A | | 9/1996 | Granich et al. |
| 5,566,389 | A | | 10/1996 | Li |
| 5,581,809 | A | * | 12/1996 | Mah ..... 2/20 |
| 5,603,118 | A | | 2/1997 | Solomon |
| 5,634,214 | A | | 6/1997 | St. Ville |
| 5,697,104 | A | | 12/1997 | Welton |
| 5,708,979 | A | | 1/1998 | Redwood et al. |
| D391,037 | S | | 2/1998 | Redwood et al. |
| D397,837 | S | | 9/1998 | Redwood et al. |
| 5,815,838 | A | | 10/1998 | Lord et al. |
| 5,867,830 | A | | 2/1999 | Chen |

(List continued on next page.)

OTHER PUBLICATIONS

Internet Pages, "Action Products", 5 pages.*

*Primary Examiner*—Gary L. Welch
(74) *Attorney, Agent, or Firm*—Carter, DeLuca, Farrell & Schmidt, LLP

(57) ABSTRACT

A golf glove which includes a glove portion having finger and thumb portions and dorsal and palm portions. The dorsal and palm portions meet along at least one conjoining lateral edge and define a pocket for receiving the eminence of a golfer's hand. The glove portion also includes a pad made from an elastomeric, non-flowing gel. The pad is preferably positioned and dimensioned to substantially encompass the wrist portion of the glove to protect the various aspects of the golfer's wrist from shock and the translation of detrimental shock-related forces due to ball-to-club impact.

8 Claims, 26 Drawing Sheets

U.S. PATENT DOCUMENTS

| | | | | | |
|---|---|---|---|---|---|
| D410,305 | S | | 5/1999 | Redwood et al. | |
| D417,061 | S | | 11/1999 | Redwood et al. | |
| 5,983,397 | A | | 11/1999 | Seminara | |
| D420,202 | S | | 2/2000 | Redwood et al. | |
| 6,044,494 | A | | 4/2000 | Kang | |
| D424,784 | S | | 5/2000 | Redwood et al. | |
| D426,922 | S | | 6/2000 | Redwood et al. | |
| 6,098,199 | A | | 8/2000 | Barkin | |
| 6,098,200 | A | * | 8/2000 | Minkow et al. | 2/161.1 |
| D431,691 | S | | 10/2000 | Redwood et al. | |
| D433,785 | S | | 11/2000 | Redwood et al. | |

* cited by examiner

Hand Reference Chart

| General Name | Specific Name (if applicable) | Ref. No. |
|---|---|---|
| | | |
| *Bones of the Hand* | | 5 |
| Radius | | 10 |
| Ulna | | 11 |
| Carpal Bones | | 12 |
| | lunate bone | 12a |
| | pisiform bone | 12b |
| | hamate bone | 12c |
| | hamulus of the hamate bone | 12d |
| | capitate bone | 12e |
| | scaphoid bone | 12f |
| | trapezium bone | 12g |
| | trapezoid bone | 12h |
| | | |
| Metacarpal Bones | | 13 |
| | I | 13a |
| | II | 13b |
| | III | 13c |
| | IV | 13d |
| | V | 13e |
| Proximal Phalanges | | 14 |
| Middle Phalanges | | 15 |
| Distal Phalanges | | 16 |
| | | |
| *Muscles of the Hand* | | |
| Flexor | | 20 |
| | pollicis brevis | 20a |
| | digiti minimi brevis | 20b |
| | carpi ulnaris | 20c |
| | carpi radialis | 20d |
| Extensor carpi ulnaris | | 21 |
| Adductor pollicis | | 22 |
| Abductor pollicis longus | | 23 |
| Lumbrical Muscles | | 24 |
| Palmar interosseous muscles | | 25 |
| Hypothenar | | 26 |
| Palmaris brevis | | 27 |

*FIG. 13A*

Hand Reference Chart

| General Name | Specific Name (if applicable) | Ref. No. |
|---|---|---|
| | | |
| Thenar | | 28 |
| Abductor pollicis brevis | | 29 |
| | | |
| *Nerves of the Hand* | | |
| Radial Nerve | | 30 |
| | superficial branch | 30a |
| Ulnar Nerve | | 31 |
| | palmar branch | 31a |
| | palmar digital branches | 31b |
| | superficial branch | 31c |
| Median Nerve | | 32 |
| | palmar branch | 32a |
| | palmar digital branches | 32b |
| Medial antebranchial cutaneous | | 33 |
| Palmar digital nerves | | 34 |
| Musculoculaneous Nerve | | 35 |
| | | |
| *Arteries and Veins of the Hand* | | |
| | | |
| Radial Artery | | 40 |
| | superficial palmar branch | 40a |
| Ulnar Artery | | 41 |
| | superficial palmar arterial arch | 41a |
| | palmar branches | 41b |
| Palmar digital arteries | | 42 |
| Radialis indicis artery | | 43 |
| Palmar metacarpal arteries | | 44 |
| Common palmar digital arteries | | 45 |
| Palmar carpal branches of radial and ulnar arteries | | 46 |
| Palmar carpal arch | | 47 |
| | | |
| | | |

*FIG. 13B*

Hand Reference Chart

| General Name | Specific Name (if applicable) | Ref. No. |
|---|---|---|
| | | |
| *Tendons and Ligaments* | | |
| Radial Bursa | | 50 |
| Ulnar Bursa | | 51 |
| Flexor | | 52 |
| | Flexor carpi radialis tendon | 52a |
| | Flexor pollicis longus | 52b |
| | Flexor digitorum superficialis tendons | 52c |
| | Flexor digitorum profundus tendons | 52d |
| | Flexor carpi ulnaris tendon | 52e |
| | Synovial Flexor tendon sheaths | 52f |
| | retinaculum | 52g |
| Palmaris longus tendon | | 53 |
| Palmar carpal ligament | | 54 |
| Palmar carpametacarpal ligaments | | 55 |
| Palmar metacarpal ligaments | | 56 |
| Deep transverse metacarpal ligaments | | 57 |
| Palmar ligaments | | 58 |
| Collateral ligaments | | 59 |
| Extensor | | 60 |
| | retinaculum | 60a |
| | carpi ulnaris | 60b |
| | digiti minimi | 60c |
| | digitorum | 60d |
| | indicis | 60e |
| | pollicis longus | 60f |
| | carpi radialis brevis | 60g |
| | carpi radialis longus | 60h |
| | pollicis brevis | 60i |
| Intertendinous connections | | 61 |
| Superficial metacarpal ligaments | | 62 |
| | | |

*FIG. 13C*

Hand Reference Chart

| General Name | Specific Name (if applicable) | Ref. No. |
|---|---|---|
| | | |
| *General Hand Features* | | |
| | | |
| Distal Limit of Palmar Arch | | 70 |
| Thenar Space | | 71 |
| Midpalmar Space | | 72 |

*FIG. 13D*

GOLF GLOVE AND METHOD OF FORMING SAME

CROSS REFERENCE TO RELATED APPLICATIONS

This application claims the benefits of and priority to U.S. Provisional Patent Application Serial No. 60/234,670 entitled "GOLF GLOVE" filed on Sep. 22, 2000 by Rita Terris and Christopher S. Terris, Provisional Patent Application Serial No. 60/255,937 entitled "GOLF GLOVE #2" filed on Dec. 15, 2000 by Rita Terris and Christopher S. Terris, Provisional Patent Application Serial No. 60/268,639 entitled "GOLF GLOVE AND METHOD OF FORMING SAME" filed on Feb. 14, 2001 by Rita Terris and Christopher S. Terris, Provisional Patent Application Serial No. 60/305,116 entitled "GOLF GLOVE #4 AND METHOD OF FORMING SAME" filed on Jul. 13, 2001 by Rita Terris and Christopher S. Terris and Provisional Patent Application Serial No. 60/305,115 entitled "GOLF GLOVE #5 AND METHOD OF FORMING SAME" filed on Jul. 13, 2001 by Rita Terris, Christopher S. Terris and Edward C. Meagher, the entire contents of all of these applications are hereby incorporated by reference.

BACKGROUND

Although golf has recently attracted younger athletes, many golfers begin playing golf much later in life due to the time and expense inherently involved with the sport. As a result, some athletes begin learning the sport in their thirties, forties and even fifties. Typically, these players enter the game after abandoning a more intense or more physically demanding contact sport such as football, hockey, lacrosse, etc. The impression most beginners have of the sport of golf is that it is a non-strenuous activity. After all, few professional athletes, except golfers, are able to pursue and actively participate in their profession into their forties, fifties and sixties. However and contrary to popular belief, golf is an intensely demanding activity and can be very strenuous on certain areas of the body especially the hand and wrist.

Therapists know that the various healing structures of the hand and wrist require protection during play. Moreover, these structures if injured require rehabilitation, time and rest to regain enough integrity and strength to resume athletic activities. Put simply, if not sufficiently rested and/or sufficiently protected, the muscles, bones, tendons, ligaments and tissues are incapable of healing adequately to prevent a reoccurrence of the problem.

Superimposed upon this demand are the following factors which tend to exaggerate or exacerbate golf-related injuries:

1. The fact that many of these "athletes" enter golf having some degree of skeletal compromise or soft tissue damage due to past injuries suffered from another sport;
2. Athletes who have previously or concomitantly participate in bat, racquet, or other stick-handling sports are accustomed to gripping the instrument firmly prior to and/or during contact with the object, puck, ball, etc. This learned behavior is difficult to modify when transitioning to golf;
3. Human frailties tend to dictate human limitations, e.g., nutrition to bones, joints, muscles and tendons and other soft tissues is significantly reduced as we age and as our overall blood supply diminishes. This increases human risk of injury and decreases human ability to recuperate from injury. Moreover, the risks of repetitive stress and/or cumulative trauma tend to increase as we age. These issues are well addressed by health professionals and by governmental agencies who work to protect the employee in the workplace. Ergonomics have entered our homes, schools and workplaces with redesigned tools and workstations. In the game of golf, repetition can only be controlled by the player's good judgment and discipline; and
4. Athletes tend to depend heavily on anti-inflammatory medications and pain medications in the belief that these medications will reduce or relieve injuries. Although these medications are generally beneficial in their ability to control the re-inflammation of acutely or chronically healing tissues, they tend to mask the injury rather than help heal the injury. In the case of an acute injury, it is paramount that the athlete maximize the degree of primary healing to prevent the likelihood of re-injuring the healing/healed tissues.

Pain and injury can be best managed by the use of protective and preventative measures which have become increasingly essential in most sporting activities (professional and recreational). Many athletic programs mandate such protective devices and mandate certain protective measures for children participating in sporting activities. The effectiveness of these protective products do not guarantee safety, but, undeniably, these products reduce the overall danger associated with participation in the sport.

FIELD OF THE DISCLOSURE

Several manufacturers have attempted to modify a conventional golf glove for a variety of different reasons, i.e., to improve a golfer's grip on the shaft of a golf club; to facilitate a golfer grasping the golf club shaft in the proper and/or ideal manner; and/or to reduce the vibration of a golf club shaft at impact. For example, U.S. Pat. No. 4,000,903 provides a small ridge across the palm of a golf glove which abuts the golf club shaft to align the shaft relative to the wearer's hand at address. U.S. Pat. No. 4,329,741 provides two parallel pads which form a valley to receive the handle of the golf club to facilitate grasping the shaft with the proper grip. Other known golf gloves also aid in the gripping of golf club shaft and are known in the art, e.g., U.S. Pat. Nos. 3,863,271, 4,329,741, and 5,253,367 disclose golf gloves having padding in the palm of the glove to aid in positioning and improve hand grip strength.

U.S. Pat. No. 5,855,022 provides visual markings disposed on the dorsal portion of the glove to aid a golfer's alignment during address. U.S. Pat. No. 6,052,827 provides a pad made from deer skin or elk skin to reduce the vibration of the club at impact. U.S. Pat. Nos. 3,848,874, 4,962,547, and 5,184,353 also describe the use of indicia to visually determine and consistently position the golfer's hands on the shaft depending upon the type of shot desired, e.g., hook, draw, fade or slice.

It is also known to make the pads from a variety of different materials such as foams, rubbers, wools (natural or synthetic), animal hides and conventional flow-like gels. Other gloves include multi-layered pads to improve comfort and performance, e.g., U.S. Pat. No. 5,855,022.

Reducing the amount of vibration traveling through the shaft to the hands at impact can aid in the relief of various maladies which affect a golfer's play, e.g., arthritis, tendonitis, carpal tunnel syndrome, "golfer's elbow", common joint disorders, etc. Golfer's elbow is caused by damage to the tendons connecting the large muscles of the forearm to the small prominences of the elbow. As a result, further vibrations and shock can be excruciatingly painful, may create further damage and may even cause a player to abandon the sport entirely. A vibration reducing pad may actually prevent more damage or injury to these affected tendons or joints.

Some manufacturers have attempted to cushion these vibrations through the addition of pad made from conventional shock absorbing materials. For example, it is known to make these vibration-reducing pads from a variety of different materials such as foams, rubbers, wools (natural or synthetic), animal hides and conventional flow-like gels, e.g., U.S. Pat. No. 5,855,022. However, the vibration reducing effects of the pads must be carefully weighed against playability with the pad and/or discomfort associated with wearing the pad during play. As can be appreciated, bulky, heavy and stiff pads will inhibit a player's performance and comfort. A golf glove must be thin and flexible to fit the wearer's hand and allow a good "feel" of the club.

Moreover and quite importantly, the associated pads, rubber, foam and/or conventional gels when used in connection with a golf glove are not specifically designed, dimensioned and positioned to protect a particular golfer's hand from a particular ailment. Still, further, many of these gloves exhibit certain characteristics (tend to "shape" or "deform" over a short time or as a result of repeated use) which do not conform to the Section 14-3 of the United States Golf Associations Rules of Golf (USGA) and, as a result, a player cannot wear the glove during competitive play. For example, section 14-3 of the USGA Rules of Golf entitled "Artificial Devices and Unusual Equipment" reads in pertinent part: Except as provided in the rules, "during a stipulated round the player shall not use any artificial device or unusual equipment:

a. Which might assist him in making a stroke or in his play; or
b. For the purpose of gauging or measuring distance or conditions which might affect his play; or
c. Which might assist him in gripping the club, except that:
   i. plain gloves may be worn;
   ii. resin, powder and drying or moisturizing agents may be used; and
   iii. a towel or handkerchief may be wrapped around the grip.

However, it is known that under certain circumstances the USGA may grant exemptions for medical-related purposes. It is contemplated that by manufacturing a glove which is specifically designed to protect an individual golfer from the onset or reoccurrence of a specific medically-related injury, the USGA may be willing to grant a medical exemption for these purposes. In other words, by selectively positioning the pad of the glove to treat a known medical condition, it is believed that the likelihood of the USGA granting a medical exemption is significantly increased.

Accordingly, there is a need for an improved golf glove which reduces and/or absorbs the detrimental effects of shock transmission/vibration resonating from the shaft and through the body as a result of club-to-ball and/or club-to-turf contact. Additionally there is a need to develop a glove which does not inhibit the wearer's performance, which will be legal for tournament and regular play, and maintains a good sense of feel through the glove.

SUMMARY

The present disclosure is designed to protect athletically-oriented patients from new, additional and/or further injury during the normal course of play. The various embodiments of the present disclosure explained in detail herein are designed to reduce the level of shock imposed upon the various parts of the body when the golf club makes contact with the ball and/or the turf. The gloves are effective in preventing the exacerbation of pre-existing conditions as well as reducing the risk of developing additional or future conditions.

It is known that under certain circumstances the USGA may grant exemptions for medical-related purposes. It is contemplated that by manufacturing a glove which is specifically designed to protect an individual golfer from the onset or reoccurrence of a specific medically-related injury, the USGA may be willing to grant a medical exemption for these purposes. In other words, by selectively positioning and dimensioning the pad of the glove to treat a known medical condition, it is believed that the likelihood of the USGA granting a medical exemption for the use of the glove is significantly increased.

Patients with such maladies as Carpal Tunnel Syndrome, so-called "trigger fingers", arthritis (and variations thereof), Dupuytren's Contracture, "Tennis elbow" and "Golfer's elbow" have greatly influenced the development of the present disclosure. Further research and development led to the development of additional embodiments of the present disclosure which focus on addressing more complex hand, wrist and thumb plaguing injuries.

The present disclosure generally relates to golf gloves and, more particularly, to a golf glove and golf glove system which includes a pad which is preferably made from an elastomeric, non-flowing gel-like polymer which is designed to effectively reduce the severity and overall detrimental effects of vibration as a result of golf club head to golf ball contact. The pad is designed to be selectively positioned and dimensioned adjacent the palm portion of the glove and/or to cover and protect other aspects of the hand according to the dimensions of a golfer's hand and the golfer's hand position relative to the golf club grip which is held by the golfer during play.

The present disclosure also relates to a method of fitting the golf glove and pad according to a golfer's hand and golfer's hand position relative to the golf club shaft. The present disclosure also relates to a method for determining the shock translation, distribution and dissipation through the fingers, hand, wrist, arm and shoulder due to ball to club impact during a golf swing.

More particularly, the golf glove includes a glove body having finger and thumb portions and dorsal and palm portions. The dorsal and palm portions meet along a conjoining lateral edge to define a pocket for receiving the eminence of a golfer's hand. The glove also includes a pad which is selectively positioned and dimensioned adjacent the palm portion of the glove according to the golfer's hand dimensions and/or the golfer's hand position relative to a golf club shaft which is held by the golfer during play.

Preferably, the pad is positioned and dimensioned in a manner to closely abut the golf club shaft during substantially the entire swing movement. In one embodiment, the pad is positioned and dimensioned to substantially cover the palmar side of the hypothenar emminence of the golfer's hand. Alternatively, the pad can be positioned and dimensioned to substantially cover the palmar side of the third, fourth and fifth metacarpal bones of the golfer's hand.

In another embodiment, the distal end of the pad is positioned and dimensioned to abut the palmar side of the metacarpophalangeal joints of the third, fourth and/or fifth metacarpal bones of the golfer's hand. The proximal end of the pad may be positioned and dimensioned to cover and/or closely abut the hamulus of the hamate bone of the golfer's hand.

In yet another embodiment, the pad is positioned and dimensioned to cover the palmar branch of the ulnar nerve, the palmar branch of the median nerve of the golfer's hand, and/or the hamulus of the hamate bone of the golfer's hand. In other embodiments the pad is positioned to at least partially encompass a portion of the golfer's wrist and the various components thereof, nerves, tendons, bones, etc. With this particular embodiment and since the positioning of the pad does not contact the club grip, the pad may be made from a material selected from the group consisting of foam, rubber, silicon, gel or other shock absorbing material. As can be appreciated, since the pad is disposed adjacent the wrist portion of the glove, USGA Rule 14-3 is not compromised.

Still other embodiments includes multiple pads which are selectively positioned to cover various aspects of the golfer's hand and wrist depending upon a particular purpose or to protect a golfer from certain injury.

In one particular preferred embodiment, the pad is made from an elastomeric, non-flowing gel-like polymer which at least partially encompasses the wrist portion of the glove. A strap (e.g., snap-lock, button, hoop and loop fastener etc.) may be employed to secure the pad about the golfer's wrist.

Preferably, the glove includes a flap which forms a compartment for receiving one or more pads. The compartment may also be positioned and dimensioned according to the golfer's hand dimensions and/or the golfer's hand position relative to a golf club shaft which is held by the golfer during play. It is envisioned that the pad may be interchanged with at least one additional pad of different thickness depending upon a particular purpose or to achieve a different or desired result.

The present disclosure also relates to a golf glove system which includes first and second gloves which each include a glove portion having a wrist portion, finger and thumb portions and dorsal and palm portions which meet along a conjoining lateral edge to define a pocket for receiving the golfer's hand. Each glove preferably includes a pad having an elastomeric, non-flowing gel-like polymer which is selectively positioned and dimensioned adjacent the palm portion of the glove (or relative to other parts of the golfer's hand or wrist). The pad(s) from at least one of the first and second gloves is configured according to at least one of the golfer's hand dimensions and/or the golfer's hand position relative to a golf club shaft which is held during play.

The present disclosure also relates to a method of fitting a golf glove which includes the steps of: measuring a golfer's hand and retrieving measurement data; constructing a glove according to the measurement data, the glove including: a glove portion having finger and thumb portions, dorsal and palm portions and a wrist portion. The dorsal and palm portions meet along conjoining lateral edges to define a pocket for receiving the eminence of a golfer's hand; and a pad.

The method also includes the step of: positioning and dimensioning the pad adjacent the palm portion of the glove according to the measurement data such that the pad closely abuts a golf club shaft which is held by the golfer during play.

Preferably, the golf glove of the constructing step is constructed from an elastomeric, non-flowing gel-like polymer and is positioned to substantially cover the palmar side of the hypothenar emminence of the golfer's hand. It is envisioned that the measurement data is retrieved using a computer algorithm. As mentioned above, the pad may also be selectively positioned to cover various aspects of the golfer's hand or wrist depending upon a particular purpose or to protect the golfer from a particular injury.

Another embodiment of the present disclosure relates to a method for determining the shock translation, distribution and dissipations through the fingers, hand, wrist, arm and shoulder due to ball-to-club impact during a golf swing. It is known that repeated shock and/or undampened or uncontrolled translational forces may cause injury, prevent healing after injury and/or contribute to overall golfer fatigue during play.

One particular method relates to the positioning of a series of sensor devices or bio-feedback interfaces at varying positions on the hand, wrist, arm, elbow and shoulder. Each sensor may be designed to operate independently or as a part of a group of sensors to determine the translation of the shock though the aforementioned parts of the body. The method also includes placing at least one sensor at varying locations on the hand, wrist, elbow, arm and/or shoulder to ascertain the resultant dampening effects of each pad with respect to the pad's particular placement or positioning on the various aspects of the hand, wrist or other body part. A series of different pads may also be positioned and measured to determine the overall dampening effects of the pad array and to maximize dampening effects as needed.

Various design combinations can address individual needs and preferences. Specific and individual problems can be evaluated, and designs can be tailored to the specific ailments of each user. For example, one embodiment include pads which are designed to protect the base of the thumb. The reference chart embodied in FIGS. 13A–13D taken in combination with the various aspects of the hand and wrist disclosed in FIGS. 1–12 are examples of specific structures which may be protected by selectively positioning the pad proximate to and or to encompass these aspects. It is intended that these aspects of the hand and wrist are incorporated by references herein as examples of areas of the hand and wrist which may be protected in accordance with the present disclosure.

BRIEF DESCRIPTION OF THE DRAWINGS

Other objects and features of the present disclosure will become apparent from the following detailed description considered in connection with the accompanied drawings. It should be understood, however, that the drawings are designed for the purpose of illustration only and not as a definition of the limits of the present disclosure.

An illustrative embodiment of the subject golf glove and golf glove system and method are described herein with reference to the drawings wherein:

FIGS. 13A to 13D are cross-referencing charts for use in identifying the various body elements illustrated in FIGS. 1–12;

DETAILED DESCRIPTION

Figure 1A:
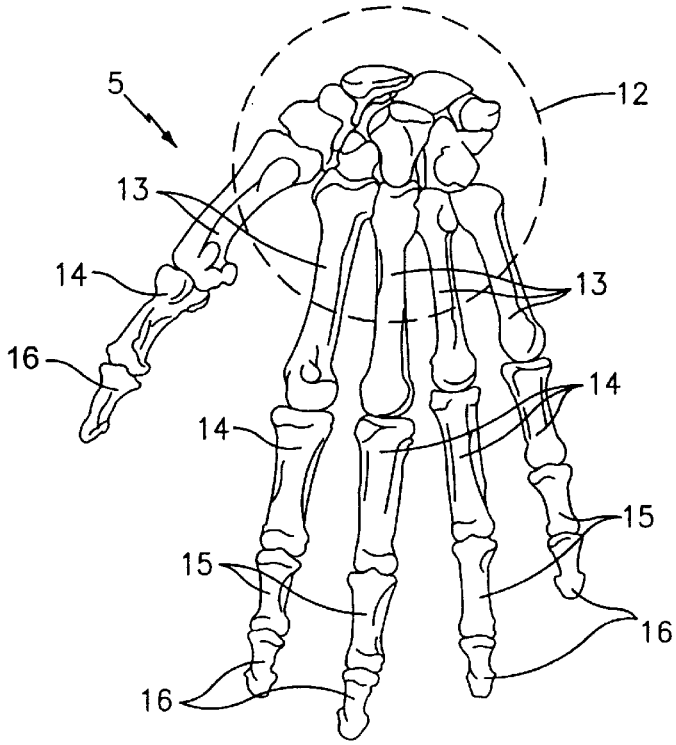
FIGS. 1–12 are illustrations of the various aspects (e.g., bones, ligaments, tendon, muscles and nerves) of the human hand and wrist.
Figure 1B:
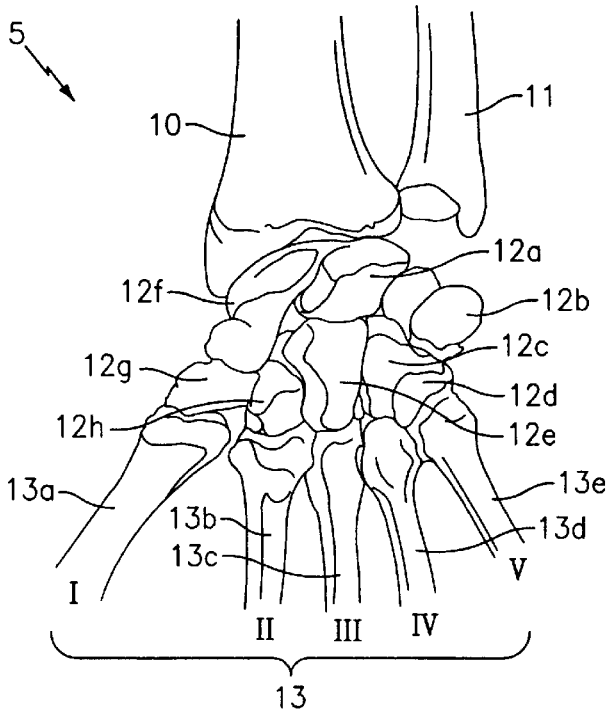
Figure 2:
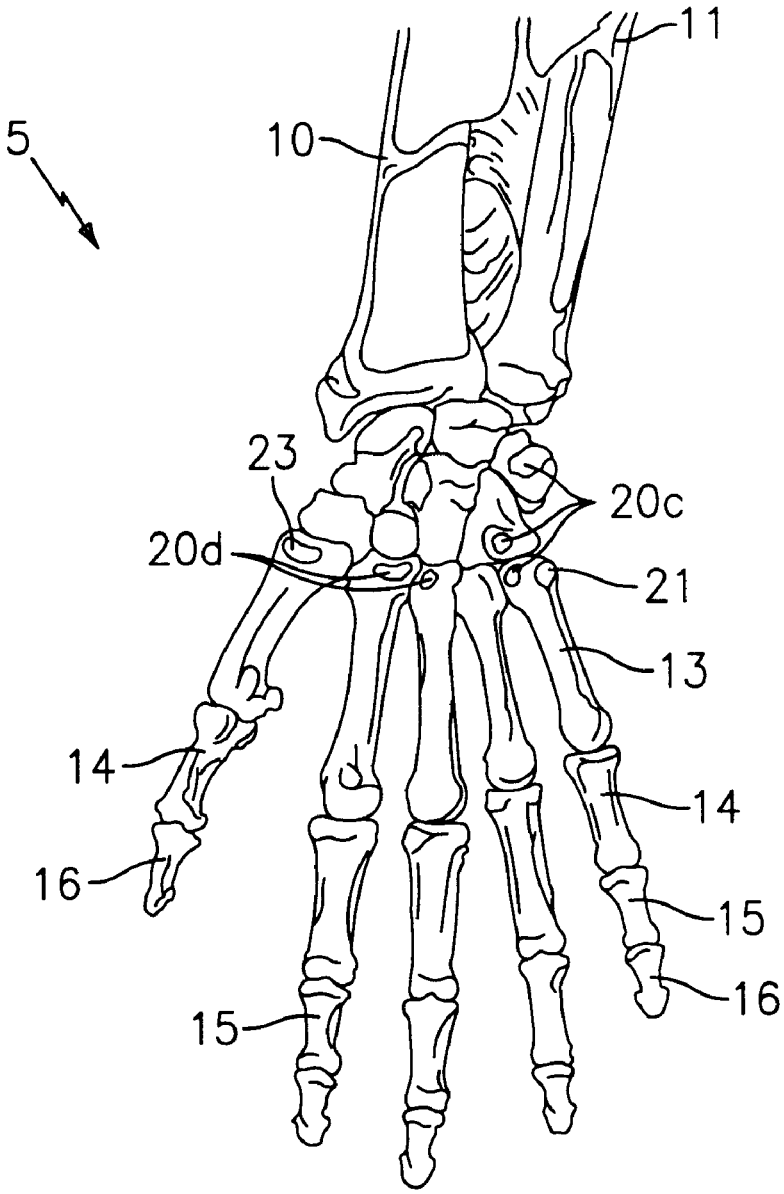
Figure 3:
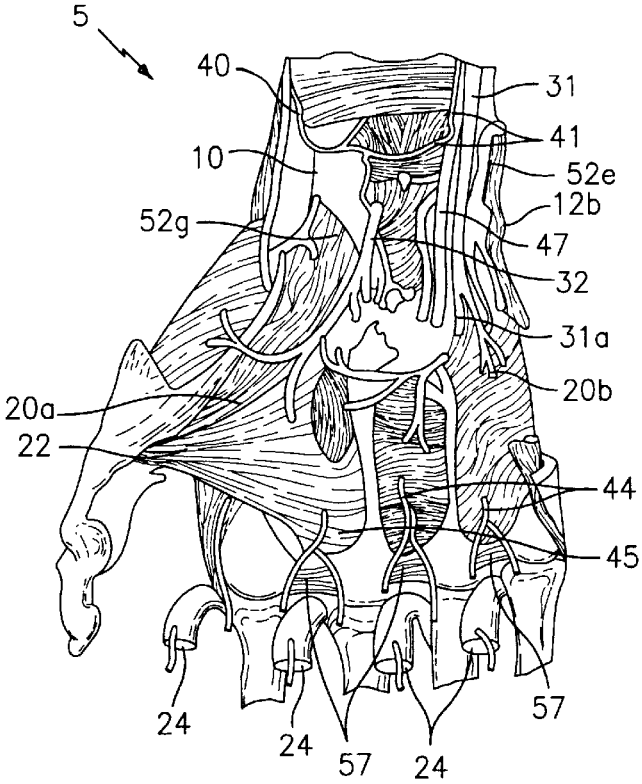
Figure 4:
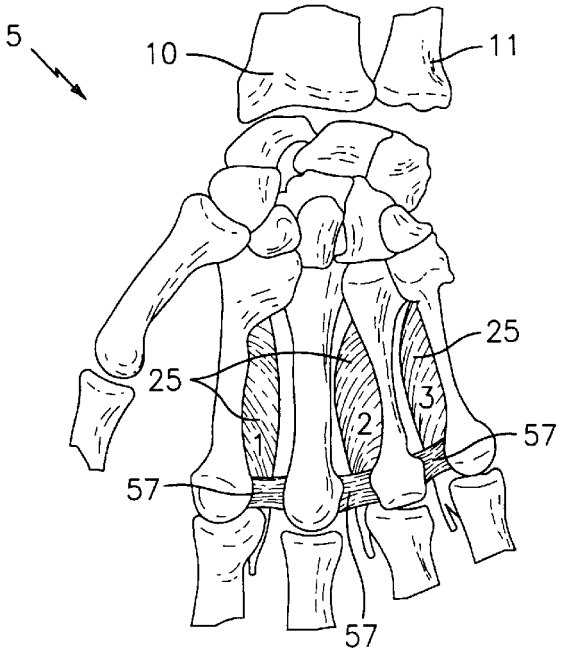
Figure 5A:
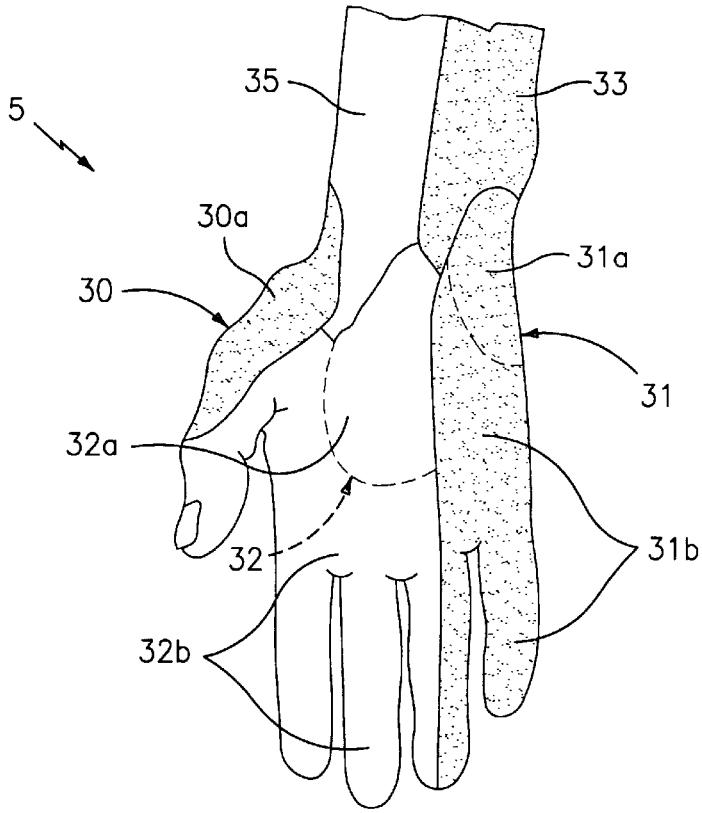
Figure 5B:
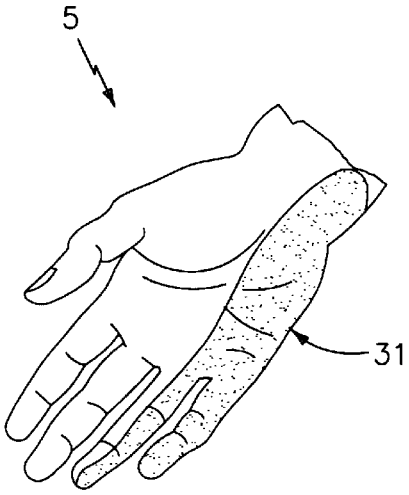
Figure 5C:
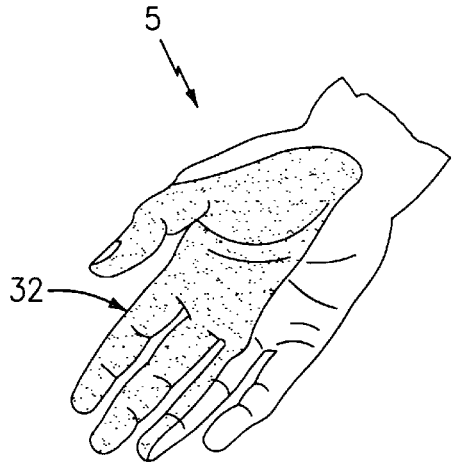
Figure 6:
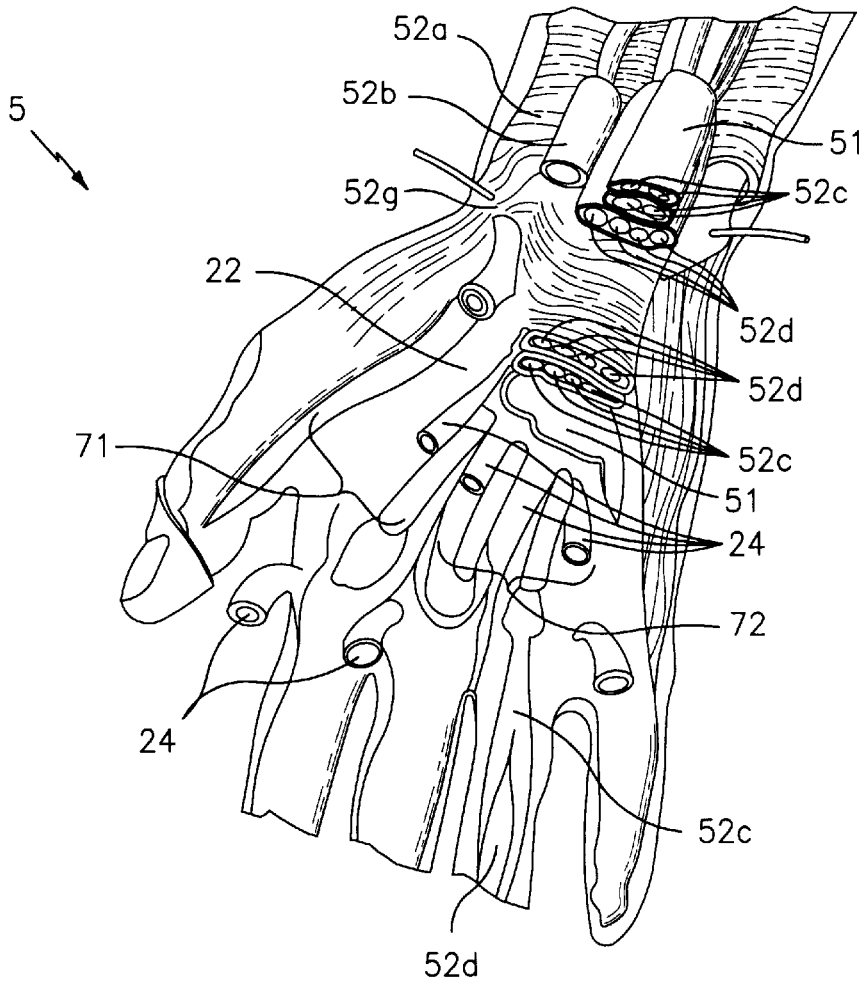
Figure 7A:
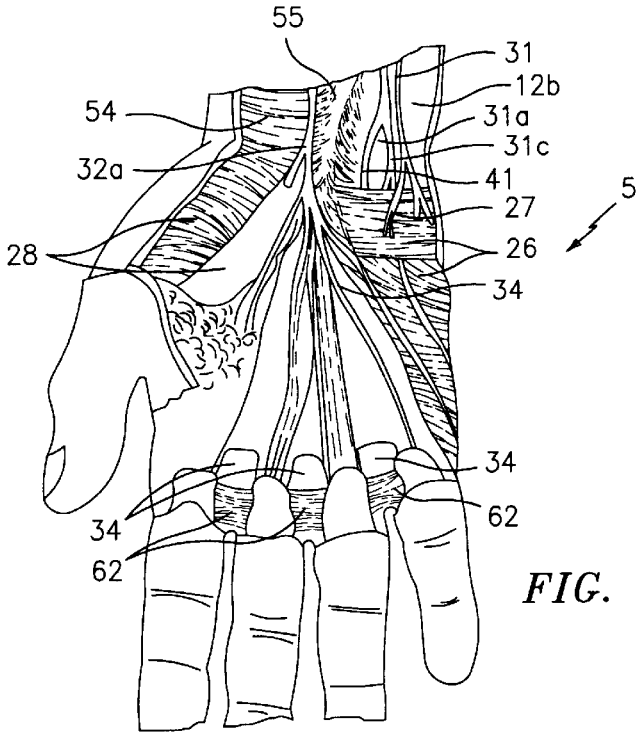
Figure 7B:
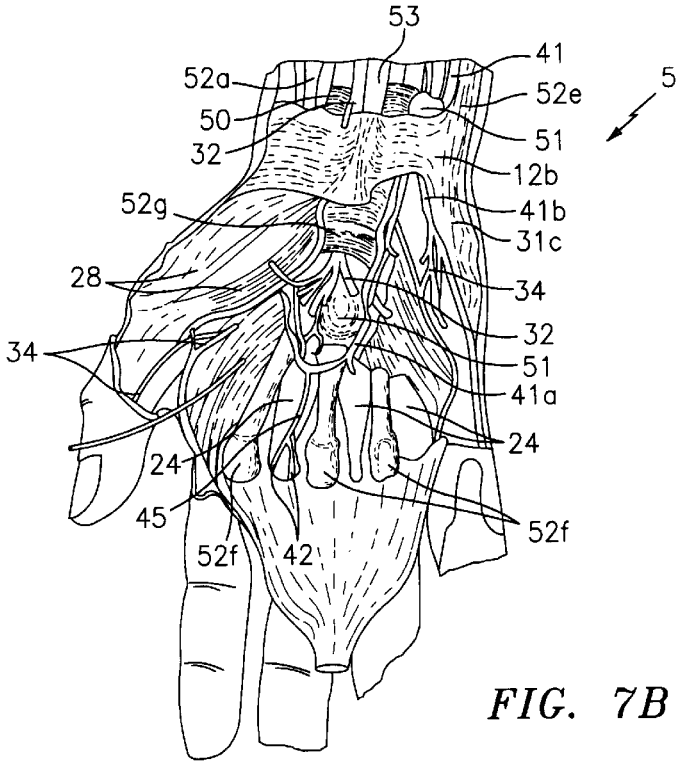
Figure 8:
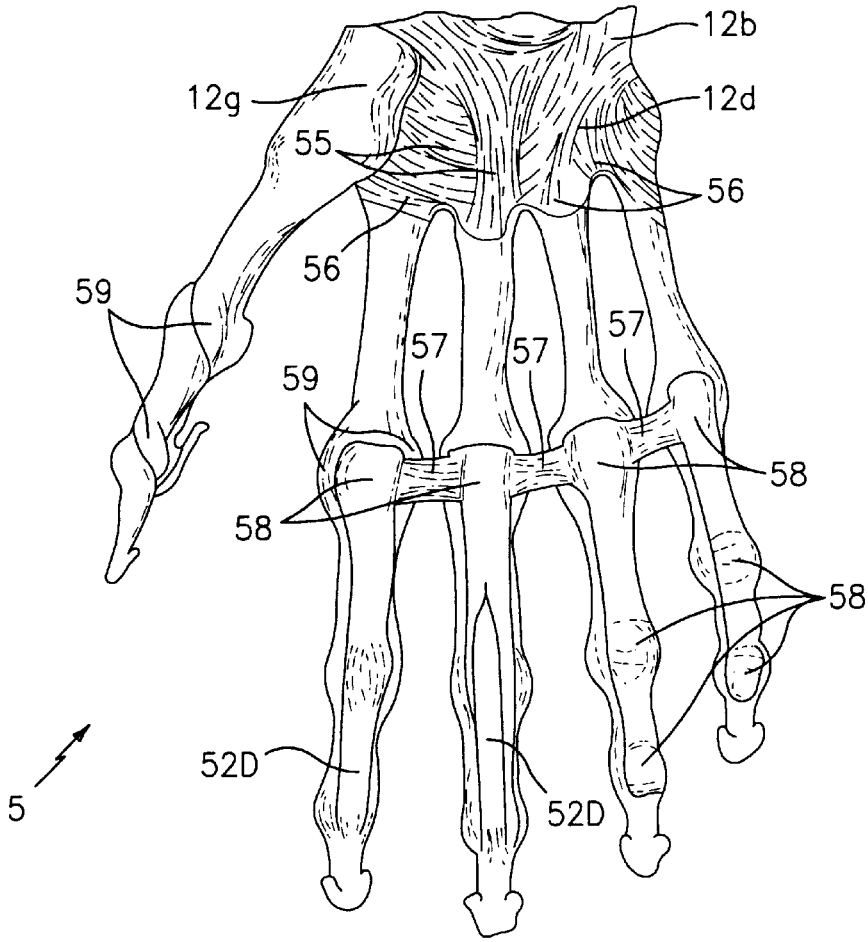
Figure 9A:
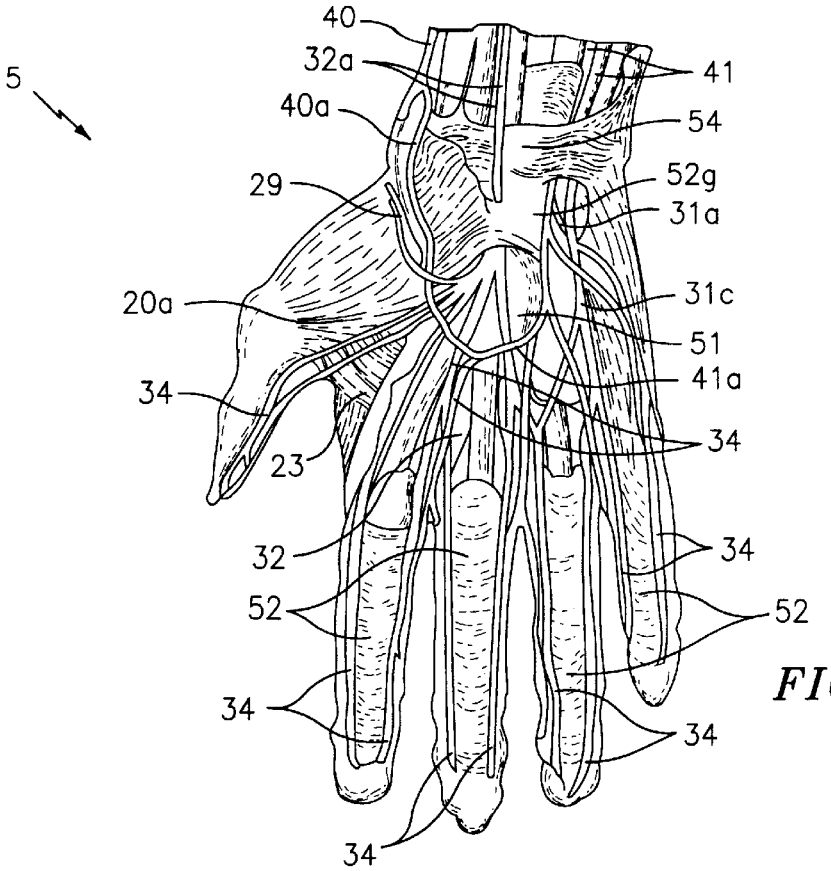
Figure 9B:
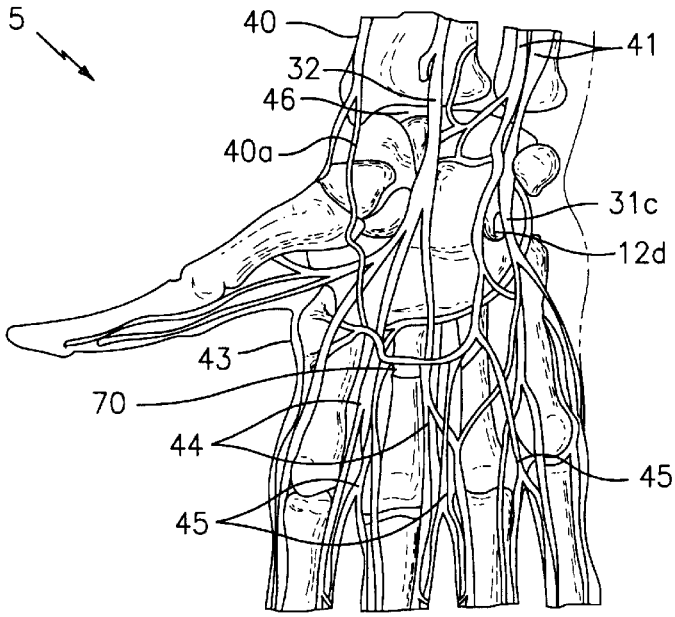
Figure 10:
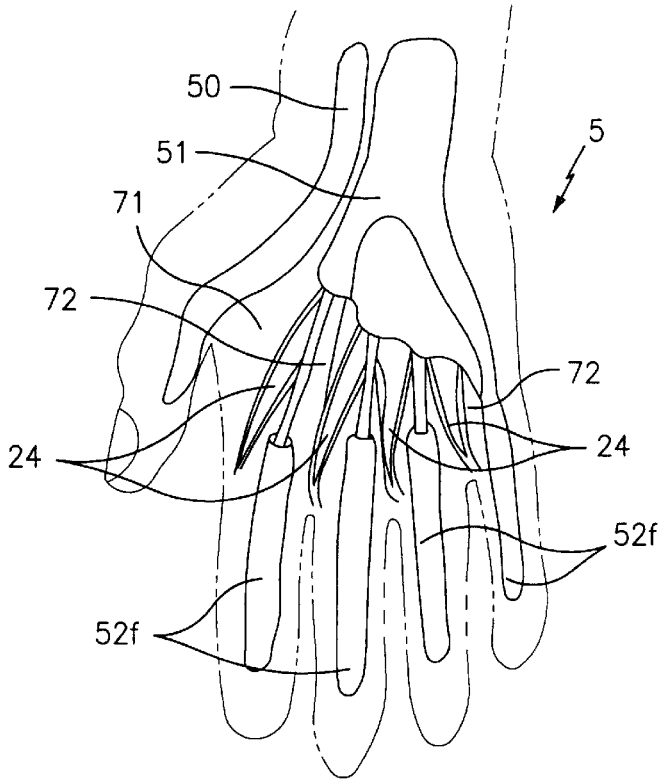
Figure 11:
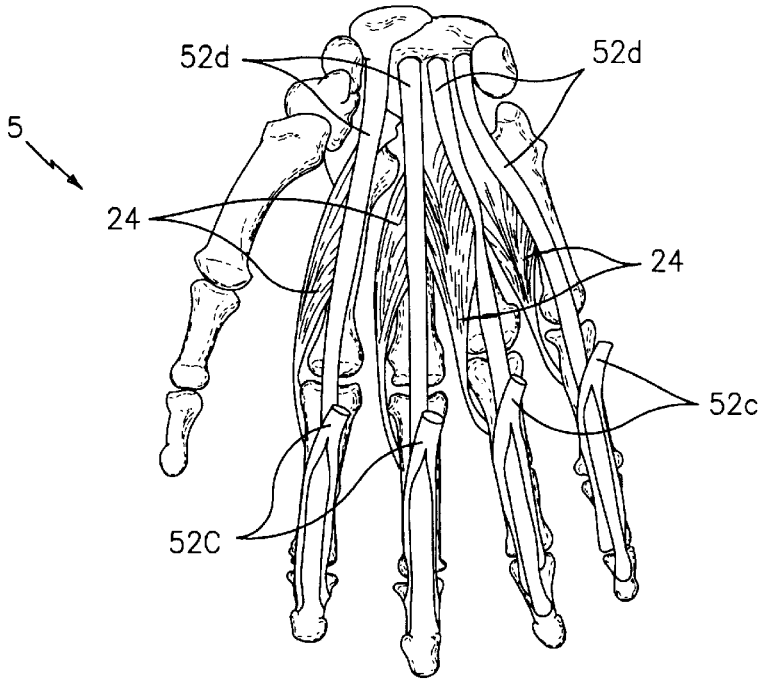
Figure 12:
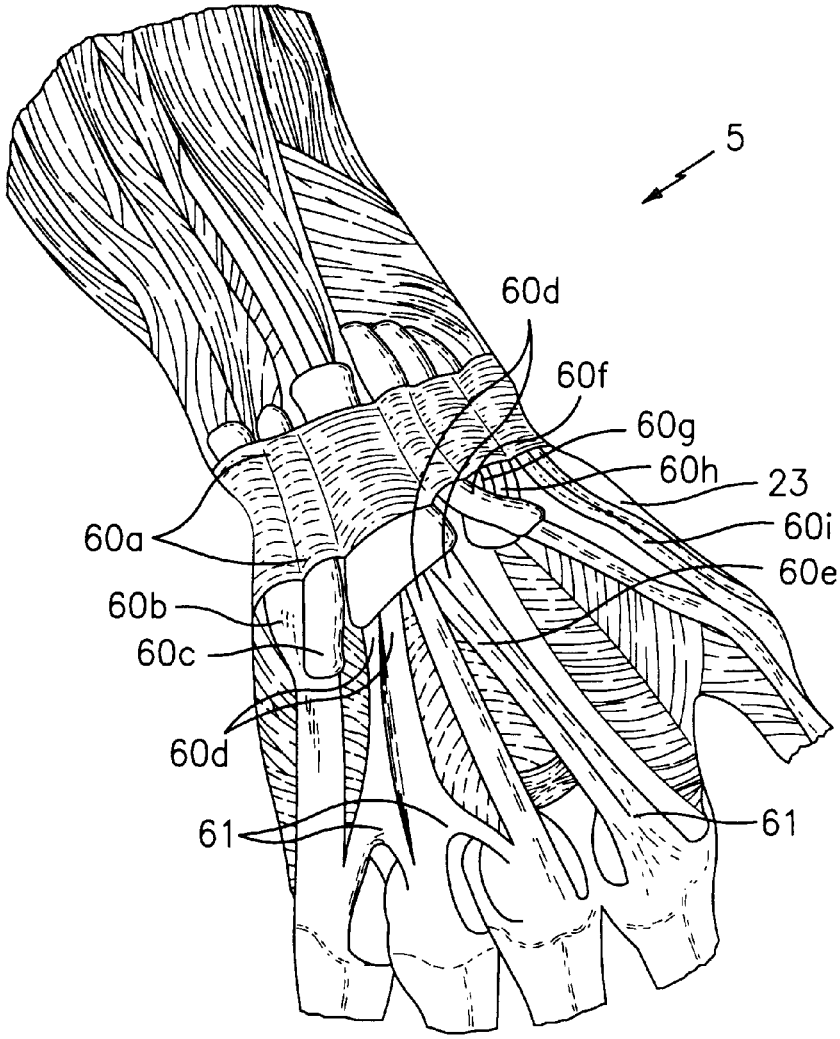

It is envisioned that the various embodiments of the present disclosure as described herein act as an "enabling tool" to allow golfers to readily progress back to the sport without causing further injury and/or regression in the golfer's rehabilitation. Apart from the inherent rehabilitative and medical benefits associated with the present disclosure, many of these players also noted significant improvement in their game due to the player's improved comfort level and ability to more easily control the complex integration of body movements required to swing the club effectively.

In general, the various embodiments of the golf gloves described herein operate to effectively reduce the level of shock imposed upon a golfer's body when the club makes contact with the ball and/or the turf. The gloves may also prove to be effective in preventing the exacerbation of pre-existing conditions as well as reducing the risk of developing new, additional or future conditions.

Referring now to the drawings in which like reference numerals identify similar or identical elements throughout the several views, FIGS. 1–12 illustrate the bones, muscles, tendons, ligaments, arteries, veins and nerves which are normally associated with the human hand and wrist. FIGS. 13A–13D is a table which cross references the names commonly associated with the various parts of the human hand as detailed in FIGS. 1–12. For the purposes herein, the table of FIGS. 13A–13D and the various named elements therein are hereby incorporated by reference into this section of the specification for the purposes of accuracy and completeness and for satisfying the requirements of 35 USC §112.

FIGS. 14A–20 show various embodiments of a golf glove 100 according to the present disclosure. The golf glove 100 includes a glove body having four finger portions 114, a thumb portion 112, a dorsal portion 120, a wrist portion 116 and a palm portion 118. The dorsal and palm portions 120, 118 meet along a conjoining lateral edge to define a pocket 130 for receiving the eminence of a golfer's hand. The glove 100 also includes a pad e.g., 150*a*–150*g*, made from an elastomeric, non-flowing gel, which is selectively positioned and dimensioned according to the golfer's hand dimensions and/or the golfer's hand position relative to a golf club shaft 160 (See FIGS. 21A and 21B) which is held by the golfer during play.

The glove 100 is preferably made from leather or synthetic leather materials or a combination thereof and can be dimensioned for right-handed players, left-handed players, male and female players, and junior players. The glove 100 can also be sized to accommodate varying hand dimensions, e.g., small, medium, large, wide width, narrow width, elongated, etc.

The glove 100 may include a series of additional elements known in the industry to improve player comfort and feel. For example, the glove 100 may include a plurality of pin-like holes 124 disposed along the finger portion 114, thumb portion 112 or dorsal surface 120 to permit the hand to "breath" during play which will add to player comfort. An elastic wrist band 126 may also be included with the wrist portion 116 which secures the glove about the golfer's wrist during play. The glove 100 may also include a 131 which mechanically engages a flap capture mechanism 132 to secure the glove 100 to the player's hand during play, e.g., a synthetic hook and loop fastening interface which adheres when pressed together commonly sold under the trademark VELCRO® (see FIG. 15B). Other fastening devices are also contemplated, e.g., snap-locks, buttons, locking tabs, adhesive gels, etc.

As mentioned above, the glove 100 includes a pad 150*a* which is preferably made from an elastomeric, non-flowing gel-like polymer which may be selectively positioned according to a player's hand dimensions or a player's hand position relative to the shaft during play. Positioning the pad 150*a*–150*g* in this manner is effective in maintaining glove-to-grip contact during the golf swing. The pad 150*a*–150*g* also absorbs shock and protects the hand from the detrimental effects of shock translation. One such gel-like polymer is manufactured by Action Products, Inc. of Maryland and is sold under the trademark AKTON®. Other unique aspects of these polymers over conventional gels is that these polymers do not leak, flow, or bottom-out over time and they do not absorb body fluids or odors. Some of the polymers are also fire-rated as self-extinguishing. Moreover, these polymers also tend to reduce overall pressure and shear which is known to reduce the onset of "pressure sores".

The elastomeric, non-flowing gel-like polymer is unlike conventional gels in that the gel-like polymer reverts to its original configuration after each deformation and only deforms to dissipate impact or shock. The pads, rubbers, foams and conventional gels of the prior art when used in connection with a golf glove tend to "shape" or "deform" over a short period of time or as a result of repeated use. As mentioned above, these characteristics do not conform to the Section 14-3 of the United States Golf Associations Rules of Golf (USGA) and, as a result, a player cannot wear the glove 100 during competitive play. Due to the unique characteristics of the elastomeric, non-flowing gel-like polymer which do not "shape" or "deform" over time or over repeated use, several embodiments of the present disclosure have already been approved for competitive play and have not been deemed in violation of Section 14-3.

The protection/prevention/comfort aspects afforded by the gel-like padding are substantially dependent on the placement of the pads 150*a*–150*g*. Therefore, it is envisioned that the pad(s) 150*a*–150*g* may be selectively positioned on the various aspects of the hand and/or hand and wrist according to a particular ailment or protect the hand from the onset of a particular ailment. Accordingly, the gloves 100 may be manufactured to protect the hand from injuries associated with the most common ailments relating to golf or the gloves 100 may be custom-made according to the particular ailments of an individual golfer.

Figure 14A:
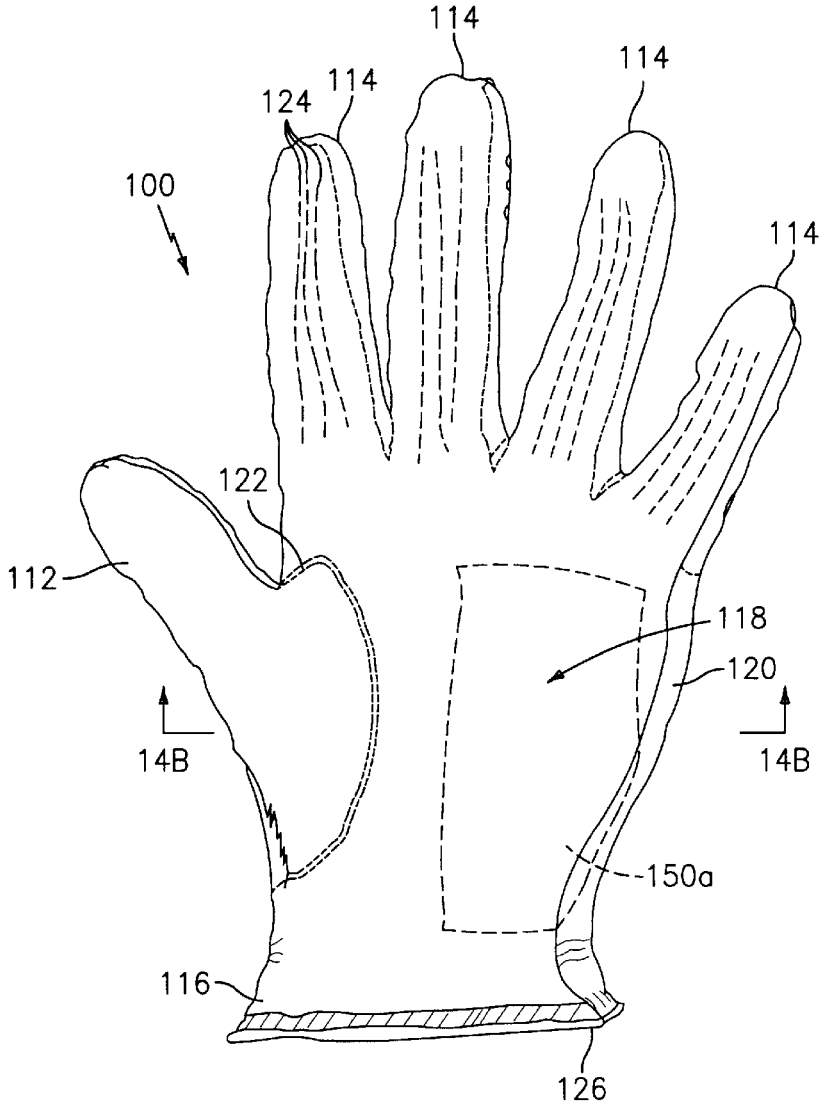
FIG. 14A is perspective view of a golf glove according to the present disclosure having an elastomeric, non-flowing gel-like pad disposed adjacent the palmar surface of the golfer's hand.
Figure 14B:
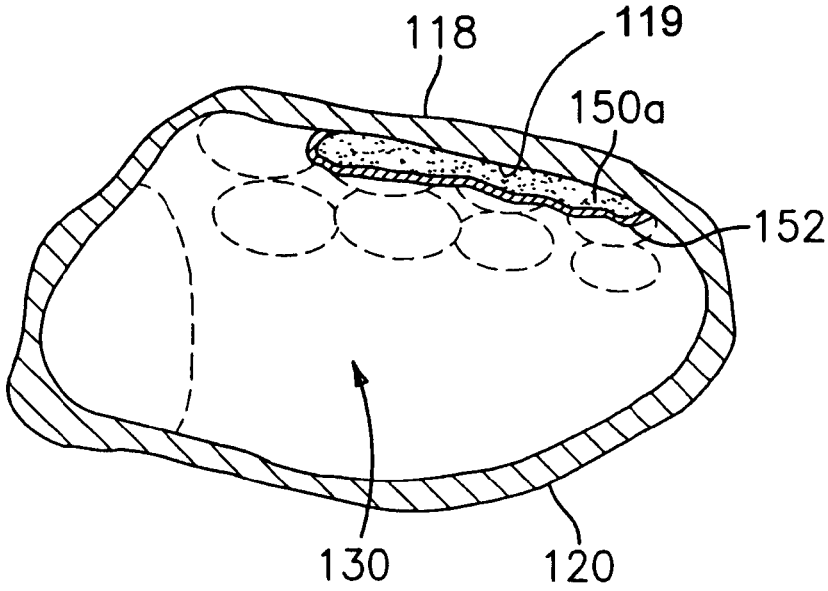
FIG. 14B is a cross sectional view taken along line 14B—14B of FIG. 14A.

For example, FIGS. 14A and 14B show one embodiment of the glove 100 wherein the pad 150*a* is disposed adjacent the palm surface 118 of the glove and extends proximate the wrist area 116. It is envisioned that the unique characteristics of the gel-like padding coupled with the novel positioning of the gel-like padding 150*a* relative to the palmar surface 118 of the glove 100 provides superior shock absorption and vibration dampening during impact of the club with the ball and the turf. As a result, direct translation of these detrimental forces to the various aspects of the hand, wrist and elbow is minimized. Moreover, further translation to the shoulder and torso may be effectively eliminated.

It is envisioned that the glove 100 of FIGS. 14A and 14B may also reduce a golfer's tendency to "overgrip" the club grip 164 which is known to be detrimental for several reasons:

1. Overgrip is known to increase the amount of shock suffered by the structures of the hand directly underlying the shaft (i.e., overgrip decreases the potential for dissipating the shock efficiently with less risk of trauma);
2. Overgrip also causes the golfer to overuse the small intrinsic muscles of the hand ("cupping" or "clenching" action) and the long extrinsic muscles in the forearm that bend the small joints of the fingers ("curling" or "squeezing"). This overuse leads to premature fatigue of these muscle structures.
3. Overgrip also initiates an increase in "motor firing" with respect to the muscles that control the wrist, forearm and elbow, i.e., "muscle tension". An increase in muscle tension is known to decrease the dissipation of shock; a system under excessive muscle tension which is exposed to shock and vibration cannot efficiently dissipated shock. This, in turn:
   i) predisposes the muscle belly (the tendons connected to the muscles and the joints) to increased detrimental forces;
   ii) predispose muscle fibers to trauma, e.g., Microtrauma to individual muscle fibers which is known to lead to "crossbridge formation" (i.e., adhesions) between the individual fibers; and
   iii) "Trigger points" (areas of "hypoxia") may also develop. These changes in muscle can occur at multiple sites within the same muscle and are known to reduce muscle strength and endurance.

The comfort aspect afforded by the gel-like padding 150*a* allows the golfer to ease his/her grip yet still feel effective control over the club 160 during the swing. Even if the golfer continues to overgrip initially, the gel pad 150*a* will provide significantly reduced trauma due to the pads 150*a* inherent impact-absorbing capacity. Additionally, less overgrip reduces the "wear and tear" on the glove 100 (commonly seen at the heel of the hand near the small finger side of the palm). It is envisioned that this may increase the "lifetime" of the glove 100.

It is also envisioned that the glove 100 and pad 150*a* design of FIGS. 14A and 14B may provide other or additional benefits such as providing protection for the various anatomical structures, providing protection against exacerbation of various medical conditions and promoting healing of certain medical conditions associated with the following known medical conditions:

Carpal Tunnel Syndrome;

Ulnar Nerve at Guyon's Canal/Ulnar Nerve compression neuropathy;

Hook of the Hamate fracture;

Stenosing Tenosynovitis ("trigger fingers");

Dupuytren's Contracture;

Tendonitis of the wrist;

"Golfer's Elbow";

"Tennis Elbow";

Arthritis and ligament injuries at interphalangeal joints;

Arthritis and ligament injuries at metacarpophalangeal joints;

Arthritis, instability, metacarpal boss at carpometacarpal joints;

Arthritis, joint instability or subluxation at basal joint of the thumb;

Arthritis and ligamentous wrist injuries at intercarpal articulations (carpal bones and intercarpal ligaments);

Arthritis and Distal Radius fractures at radiocarpal joint;

Growth Plates of all of the skeletal long bones (Epiphyseal injury); and

"Raynaud's Disease" which effects the vascular structures in hand.

FIG. 14B shows the position of the pad 150*a* against an inner-facing surface 119 of the palm portion 118. It is envisioned that the pad could be sewn or other wise attached atop the palm portion 118 depending upon a particular purpose. More particularly, after the appropriate position of the pad 150*a* is determined (as explained in more detail below with respect to the one the methods described herein), the pad 150*a* is sewn (or otherwise attached) against the inner-facing surface 119 of the palm portion 118. The pad 150*a* may include an outer layer 152 of material which encapsulates the gel-like pad 150 and enables the outer periphery of the pad 150*a* to be positioned without damaging or compromising the gel. For example, it is envisioned that the pad may include an outer layer 152 made from leather or other materials such as MOLESTICK™ manufactured by Allimed.

Figure 15A:
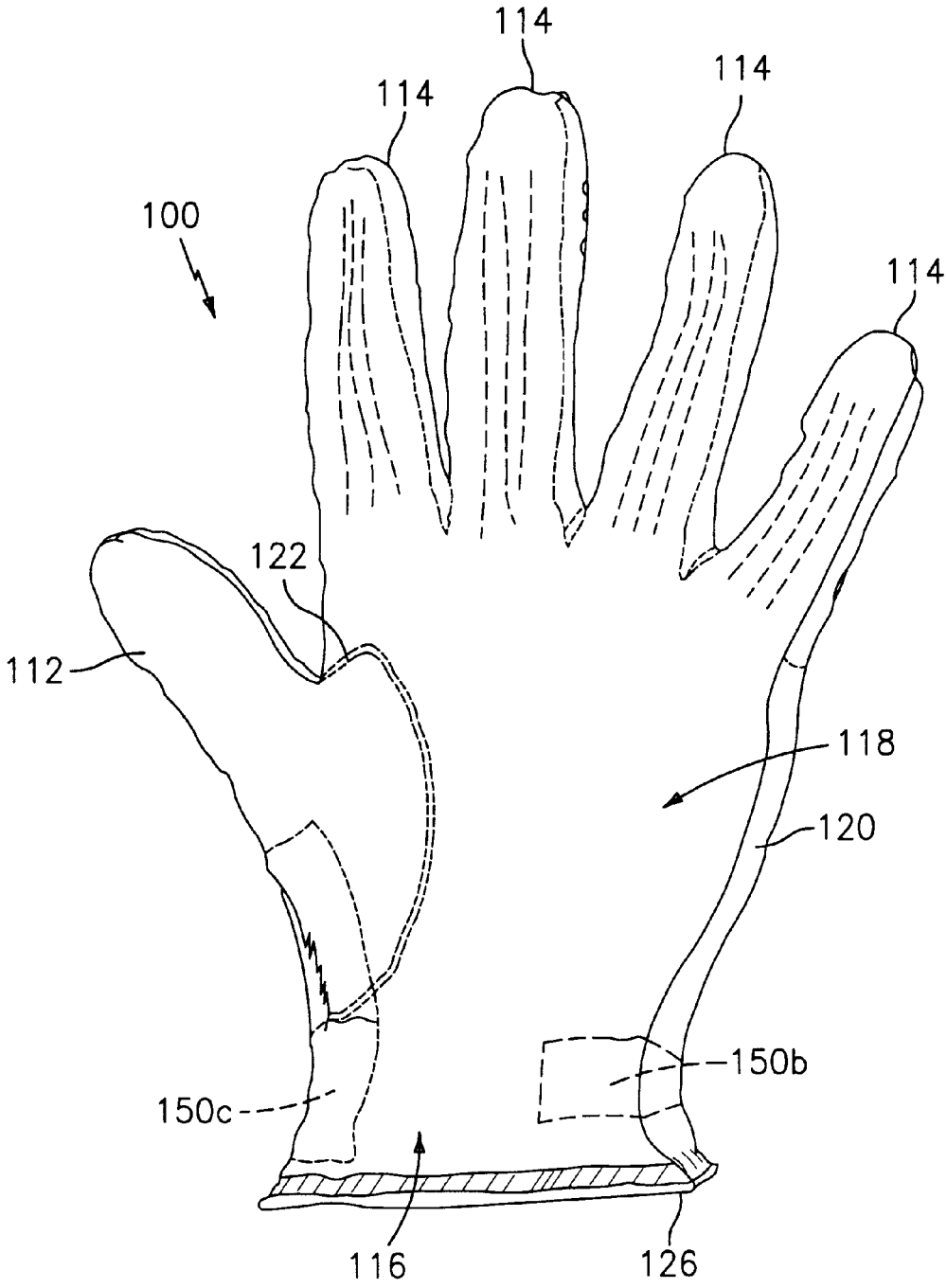
FIG. 15A is a front, perspective view of another embodiment of the golf glove according to the present disclosure having two gel-like pads each disposed proximate the wrist of a golfer's hand.
Figure 15B:
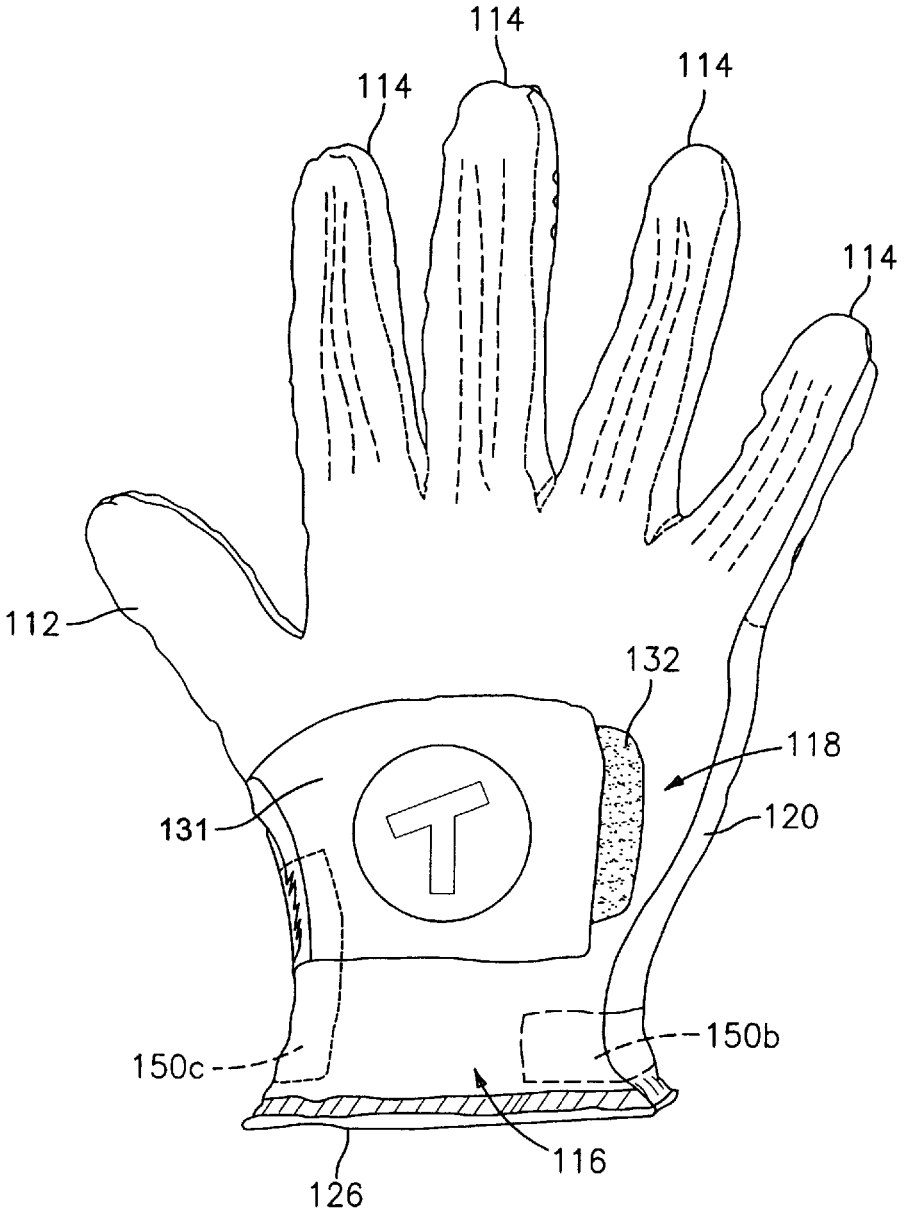
FIG. 15B is a dorsal, perspective view of a right-handed golf glove according to the present disclosure.

FIGS. 15A and 15B show another embodiment according the present disclosure which includes a glove 100 having a series of pads 150*b* and 150*c* which are specifically positioned to provide shock absorption and cushioning along the various aspects of the wrist and lower base portion of the thumb. It is known that during a normal golf swing, the wrist joint moves through a full arc of radial and ulnar deviation causing the carpal bones associated with the wrist to move or slide relative to one another. As a result, undue stress is placed on the multitude of complex intercarpal ligaments associated with the wrist. It is contemplated that disposing pads 150*b* and 150*c* on the radial and ulnar aspects of the glove 100 and securing the pads against the wrist joint will enhance the cushioning and shock absorption characteristics of the glove 100 with respect to the various aspects of the joints, ligaments, tendons and nerves of the wrist.

Positioning pad 150*c* (or 150*d* described below) relevant the lower base of thumb portion 112 is envisioned to provide comfort and protection for the arthritic, subluxed or unstable carpometacarpal joint of the thumb. This decreases trauma to the particular cartilage and ligamentous structure of this complex joint. It is contemplated that positioning the pad 150*c* in this manner may also protect tendons of the thumb (i.e., DeQuervains) and also protect underlying scaphoid bone (i.e., carpal bone).

FIG. 15B shows the back of the glove 100 which includes a flap-like strap 131 for securing the glove 100 to the golfer's hand during play. The glove 100 is designed to be non-restrictive and provide comfort for the thumb as the club weight bears on the thumb during the back swing and follow through phases of the golf swing.

It is also envisioned that the glove 100 and pad 150*b*, 150*c* configuration of FIGS. 15A and 15B may benefit the following known medical conditions:

DeQuervain's Tenosynovitis;

Wrist tendonitis associated with the extensor and flexor tendons of the carpi ulnaris and carpi radialis tendons;

Triangular Fibrocartilage Complex (TFCC) strains and tears;

Distal Radioulnar instability;

Arthritis and joint instability;

Bennett's Fracture;

Scaphoid Fractures, e.g., Kienbock's Disease

Intercarpal ligaments and articulations

Figure 16:
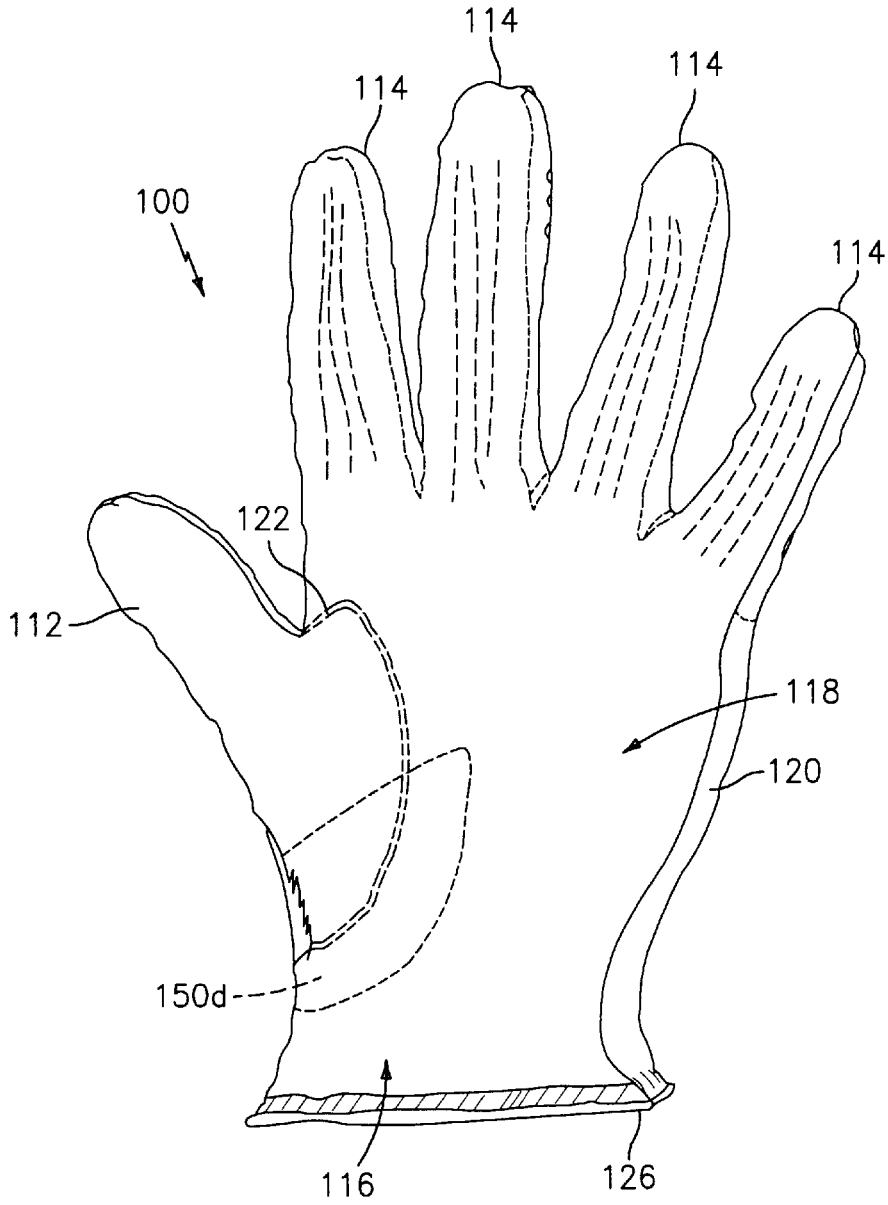
FIG. 16 is a perspective view of another embodiment of the golf glove according to the present disclosure having a gel-like pad disposed proximate the base of a golfer's thumb.

Ligament Injuries, e.g., ligamentous laxity (commonly seen in women and during youth); and Ligamentous wrist injury FIGS. 16–20 show other envisioned glove designs which include pads 150*d*–150*f* which are uniquely shaped and positioned to reduce the level of shock imposed upon the various aspects of the hand and wrist during impact and/or reduce the translation of the shock to the other parts of the body after impact. For example, FIG. 16 shows another envisioned glove 100 design wherein the pad 150*d* is disposed adjacent the base of the thumb portion 112. The pad 150*d* is shaped to at least partially extend into the palm portion 118.

Figure 17:
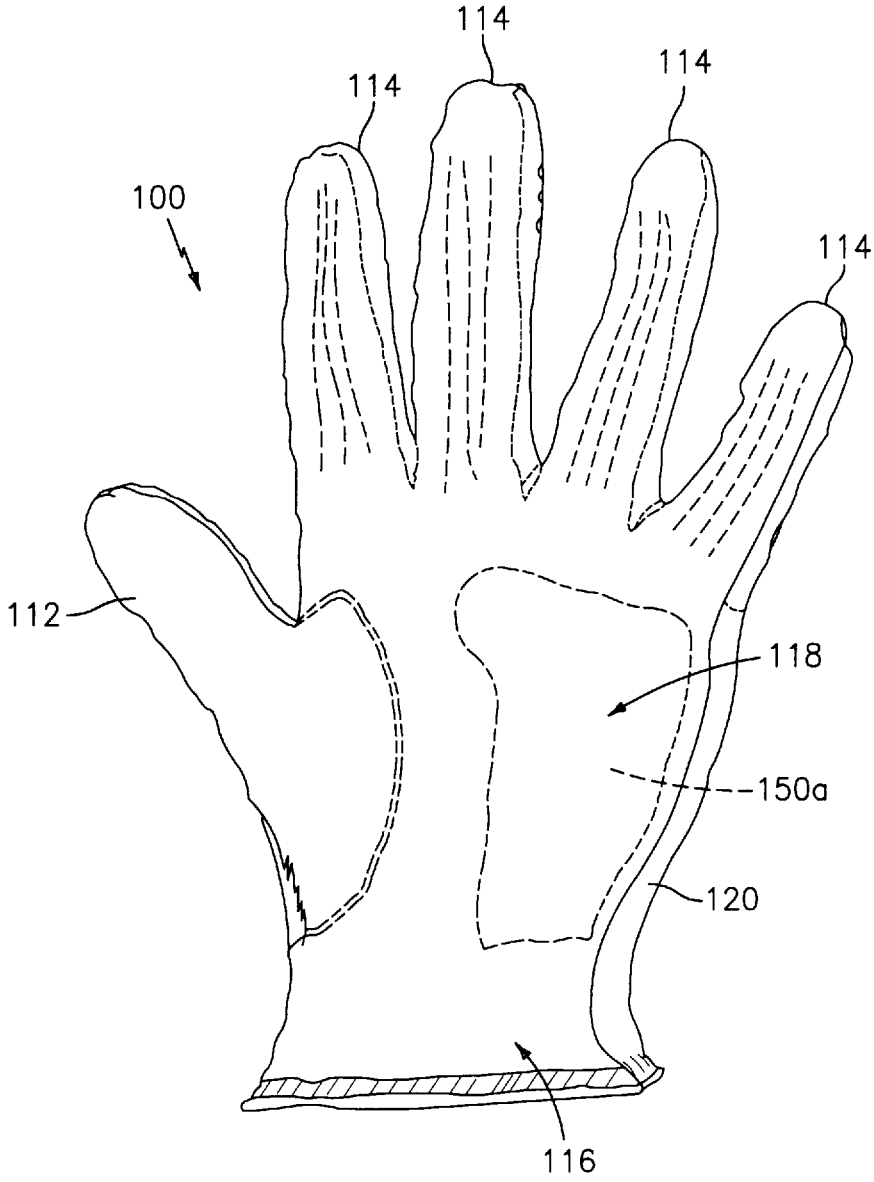
FIG. 17 is a front, perspective of another embodiment of the golf glove according to the present disclosure having a gel-like pad disposed proximate the palmar surface of a golfer's hand and extending across the metacarpal ligaments and joints.
Figure 18:
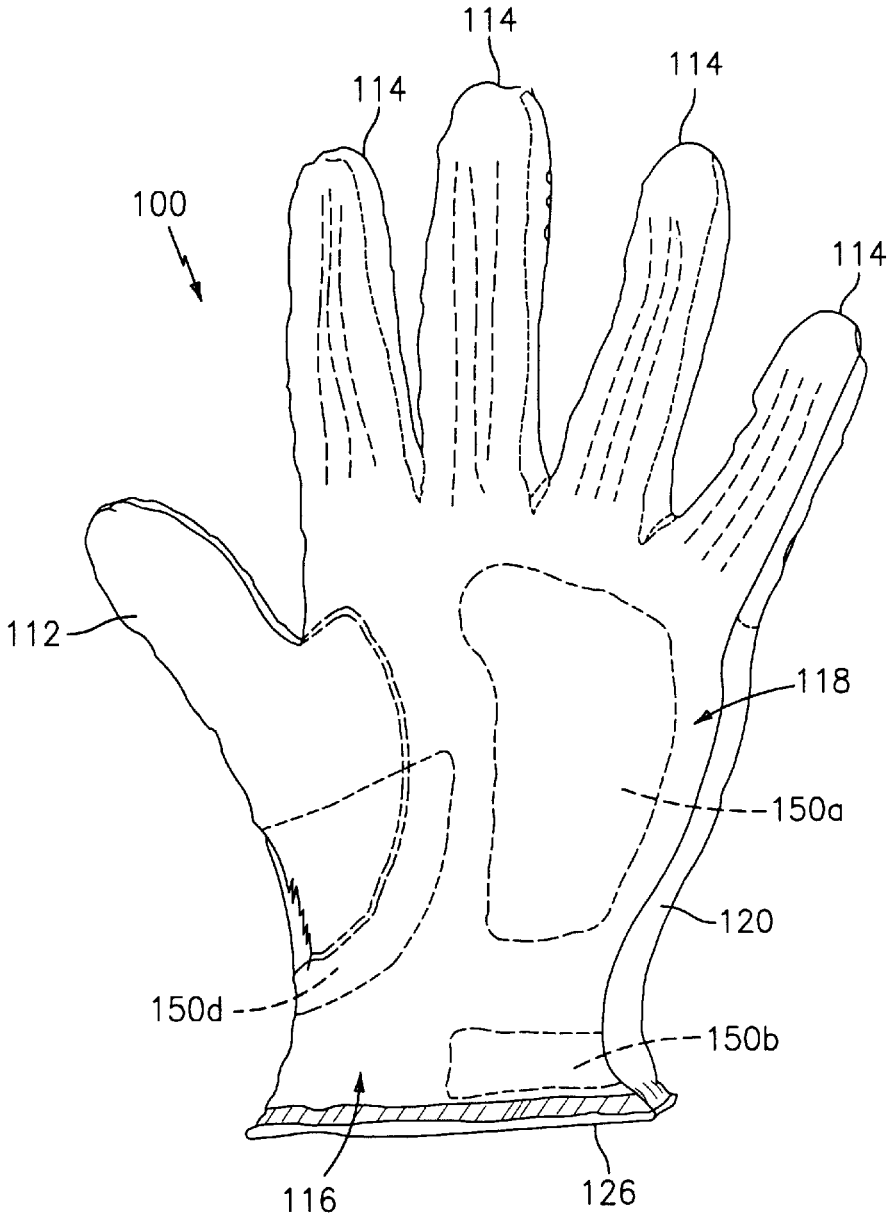
FIG. 18 is a perspective view of another embodiment of the golf glove according to the present disclosure having a plurality of gel-like pads disposed at various positions about the palm, wrist and thumb of a golfer's hand.

FIG. 17 shows another pad 150*e* which is shaped to cover the palm portion 118 of the glove 100 and extend across the metacarpophalangeal joints of the third, fourth and fifth metacarpal bones 13*c*–13*e* (FIG. 1B), respectively, of the golfer's hand. FIG. 18, shows yet another embodiment of the present disclosure wherein the glove 100 includes a plurality of pads, 150*a*, 150*b*, and 150*d* which protect the palm, wrist and base of the thumb, respectively, of the golfer's hand. As can be appreciated, any combination of the pads 150*a*–150*g* may be selectively positioned within the glove 100 to protect the various aspects of the golfer's hand, wrist, elbow, arm and shoulder during play.

Figure 19:
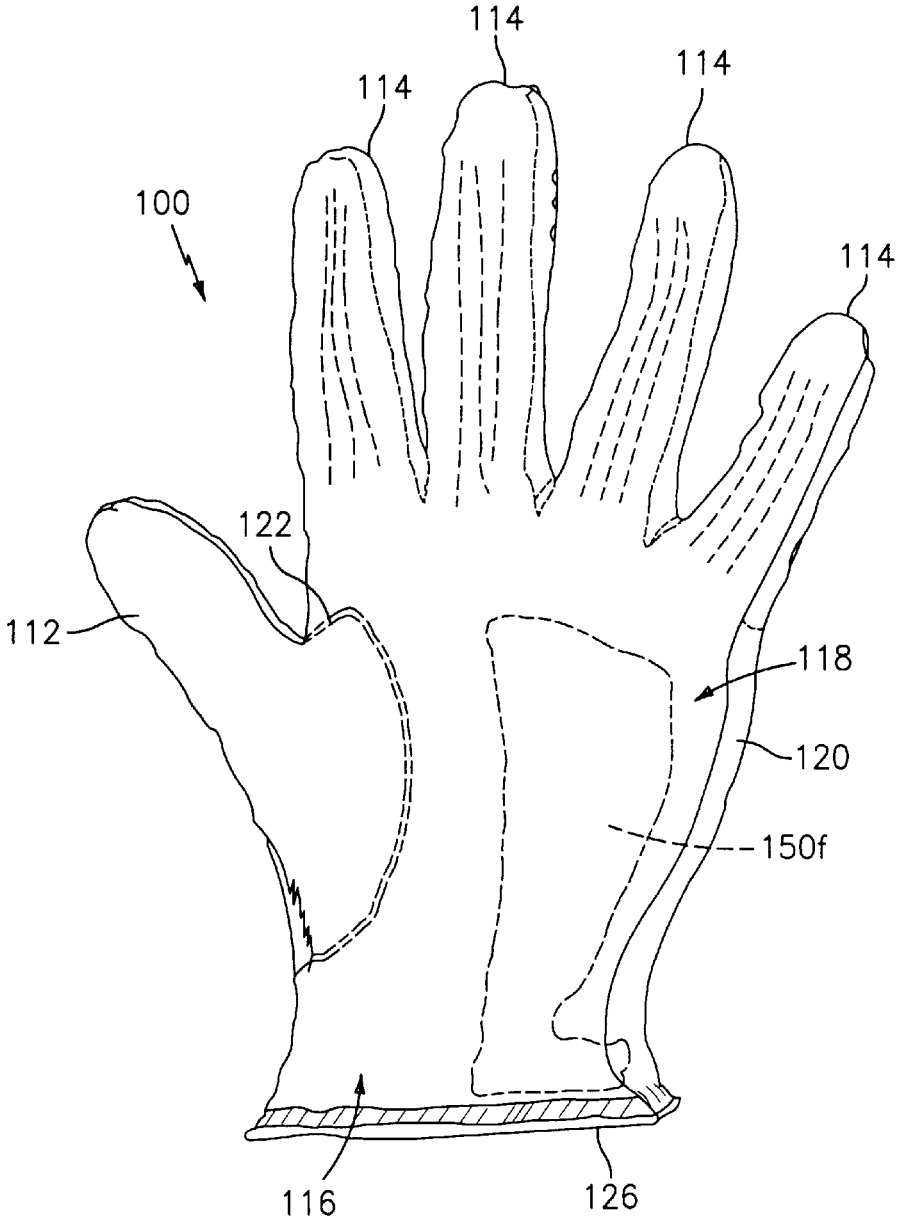
FIG. 19 is a perspective view of another embodiment of the golf glove according to the present disclosure having a gel-like pad disposed proximate the palmar surface of the hand and extending across the radial and ulnar portions of the wrist.
Figure 20:
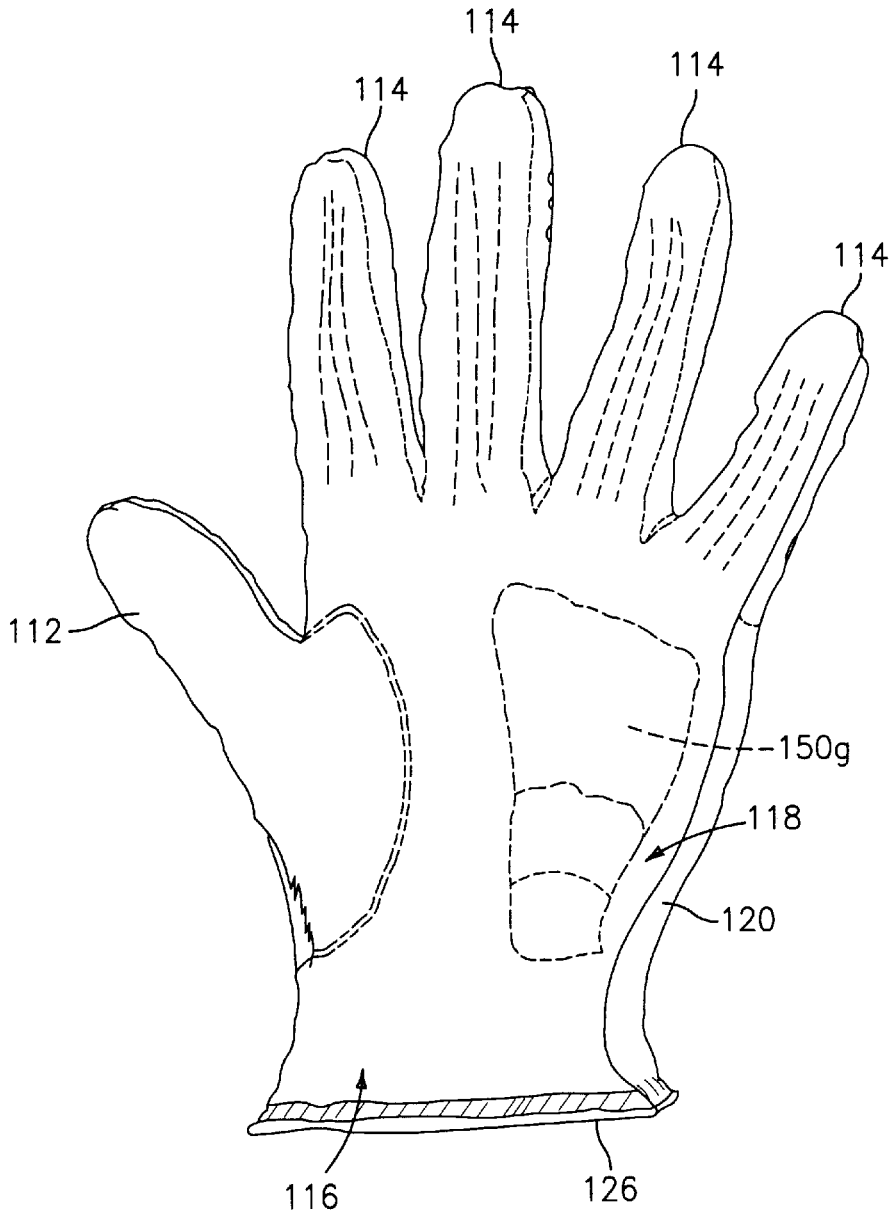
FIG. 20 is a perspective view of another embodiment of the golf glove according to the present disclosure having a plurality of stacked, gel-like pads disposed proximate the palmar surface.
Figure 21A:
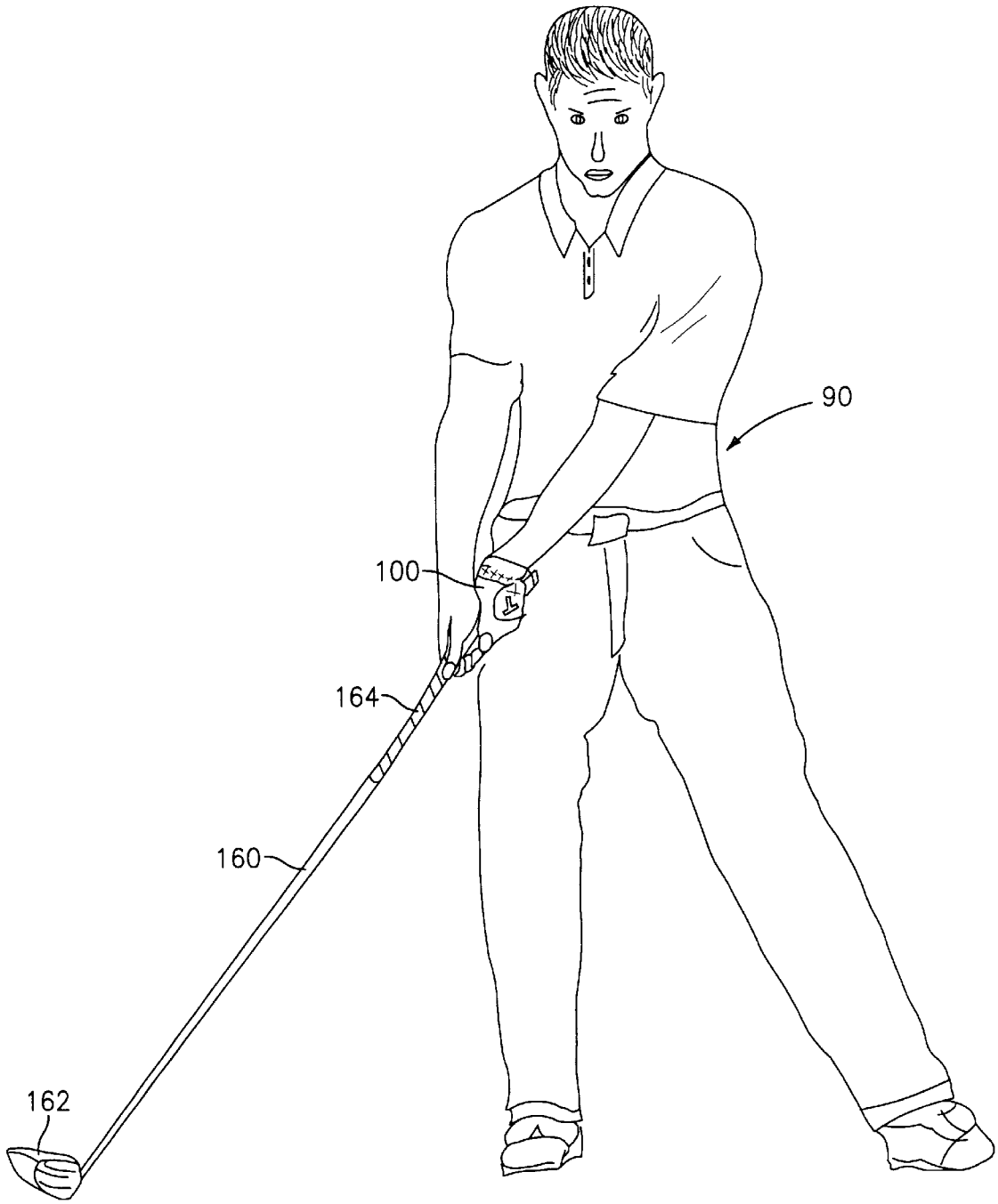
FIG. 21A is a side view of a golfer gripping a golf club shaft during the swing movement while wearing the golf glove according to the present invention.

FIG. 19 shows still yet another pad 150*f* which is positioned adjacent the palm portion 118 and extends across the wrist portion 116 to dissipate shock to these aspects of the hand and wrist. FIG. 20 shows a double-layered pad 150*g* which is disposed adjacent the palm portion 118 of the glove 100. It is envisioned that the double-layered design may further reduce the shock to these aspects of the golfer's hand. One or more of the aforedescribed pads 150*a*–150*g* may also be designed to have multiple layers of the gel-like polymer with other fluids disposed therebetween which may further reduce the detrimental effects of vibration and shock to the hand and wrist at impact or during translation.

Figure 21C:
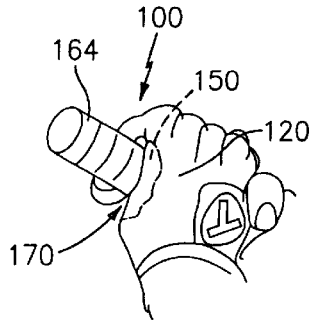
FIG. 21C is an enlarged view showing the gel-like pad maintaining the golfer's hand in close contact with the golf club shaft/grip during the swing movement.
Figure 21B:
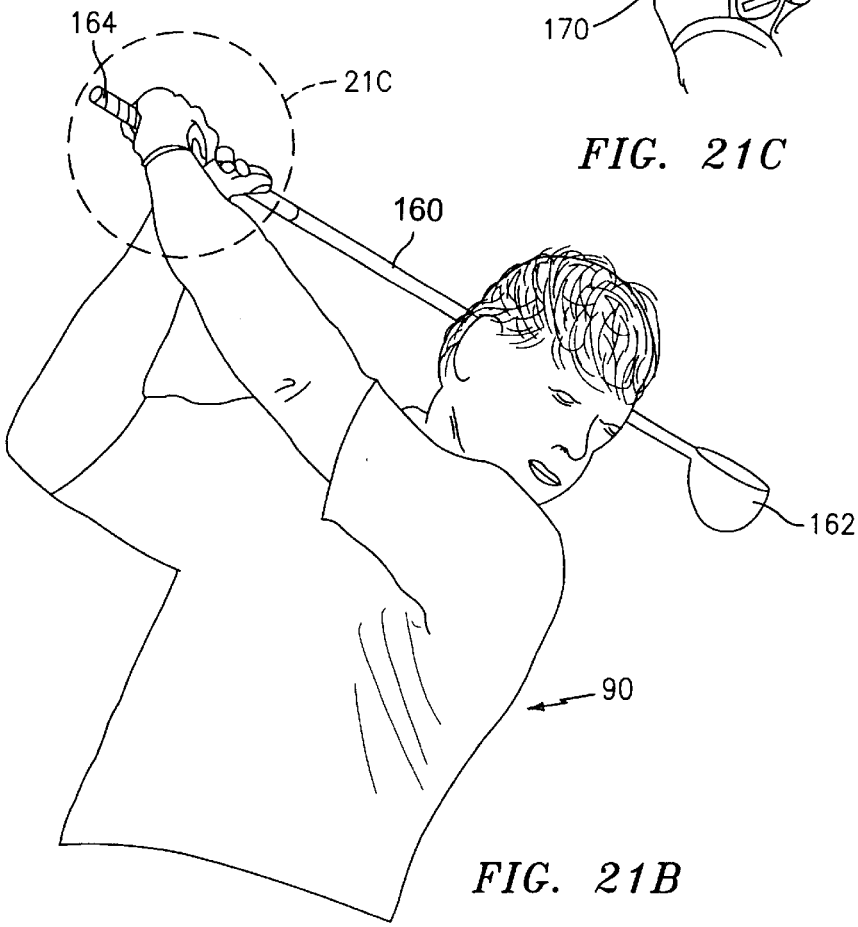
FIG. 21B is a view of the golfer at mid-swing.
Figure 21D:
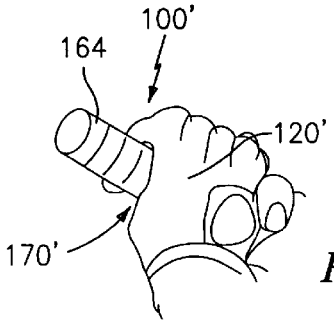
FIG. 21D is an enlarged view of a conventional golf glove illustrating the formation of a gap between the golfer's hand and the shaft during the swing movement.
Figure 22:
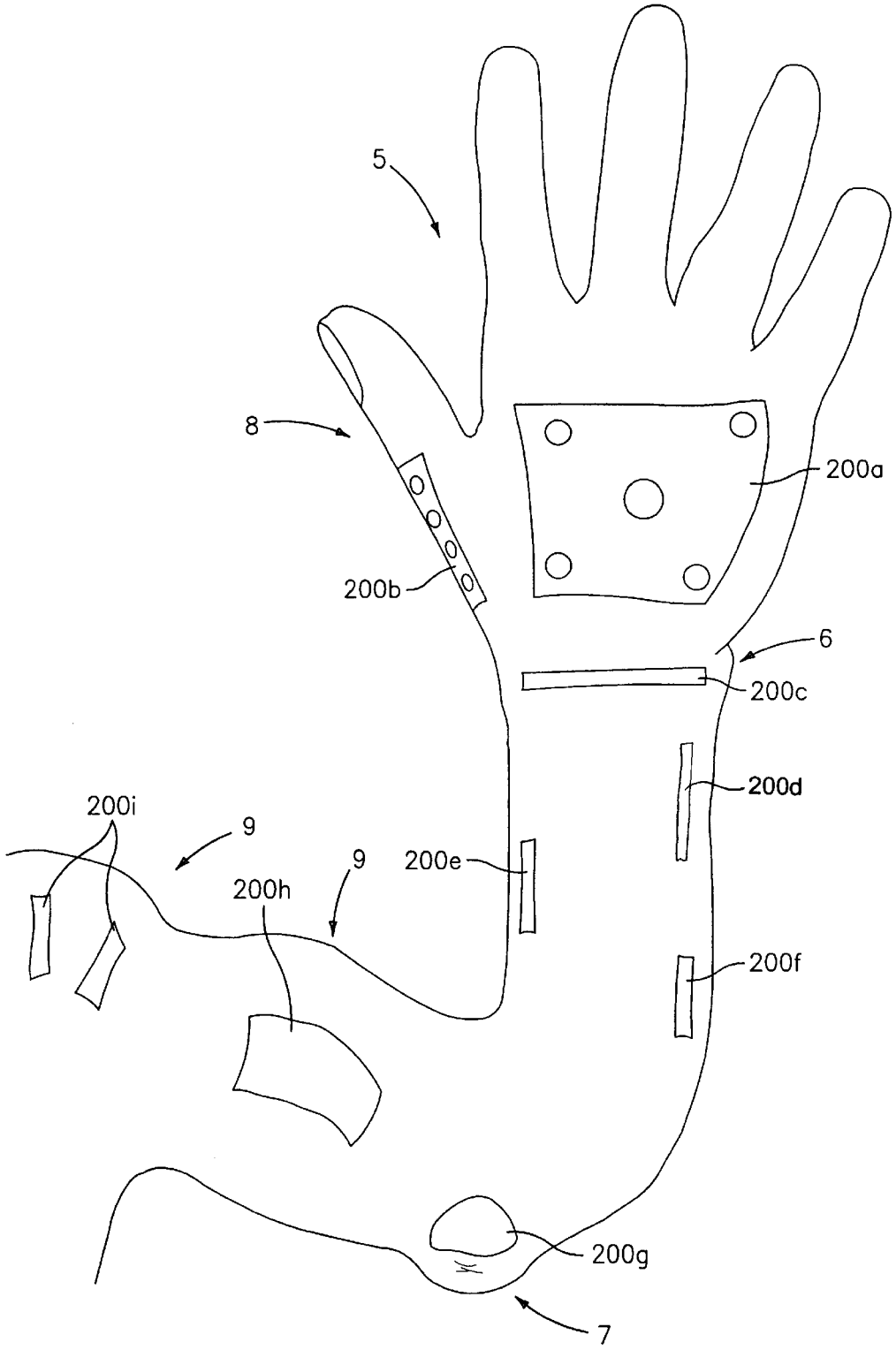
FIG. 22 is a schematic view showing a series of biofeedback sensors which are positioned on the various aspects of the hand, wrist, arm and shoulder to determine the shock translation through these body components as a result of club to ball/turf impact.

As mentioned above, It is envisioned that the pads 150*a*–150*g* and/or placement of the pads 150*a*–150*g* tend to reduce a golfer's tendency to "overgrip" the club grip 164 since the pad 150*a*–150*g* enables the golfer to maintain a consistent grip with the club grip 164 during the entire swing movement. For example, FIGS. 21A–21D show the swing movement of a golfer while gripping a golf club 160. It is known that at a point when the golfer's swing movement reaches the top of the swing (FIG. 21B), the club grip 164 tends to pivot away from the golfer's hand/glove 100 thus forming a gap 170 between the golfer's glove 100 and the grip 164 (see FIGS. 21C and 21D). Ideally, the downward swing movement reinitiates the same glove-to-grip 164 interface causing proper and consistent ball flight. However, this is not always the case and, typically, some slip between the hand and glove 100 is evident which may cause the ball to fly off-line (e.g., hook, slice, etc.). FIG. 21C shows an enlarge view of the glove 100 according to the present invention wherein the gap 170 is minimal compared to the gap 170' formed utilizing the conventional glove 100' of FIG. 21D. As can be appreciated, selectively positioning pad 150*a* for the particular golfer will maintain the golfer's club grip 164 in substantial contact with the glove 100 during the entire swing movement thus reducing the formation of a gap 170 and reducing the chances of club slippage. It is envisioned that this reduction in slippage will promote more consistent ball flight.

Another embodiment of the present disclosure relates to a method for determining the shock translation, distribution and dissipations through the hand 5, thumb 8, wrist 6, elbow 7 and upper portions of the arm 9 (bicep and shoulder) due to ball-to-club impact during a golf swing. One particular method relates to the positioning of a series of sensor devices or bio-feedback interfaces 200*a*–200*i* at varying positions on the hand 5, thumb 8, wrist 6, elbow 7 and upper portions of the arm 9. Each sensor 200*a*–200*i* may be designed to operate independently or as a part of a group of sensors to determine the translation of the shock though the aforementioned parts of the body.

The method also includes placing at least one sensor 200*a*–200*i* at varying locations on the hand 5, thumb 8, wrist 6, elbow 7 and upper portions of the arm 9 to ascertain the resultant dampening effects of each pad, e.g., 150*a*, with respect to the pad's 150*a* particular placement or positioning on the various aspects of the hand, wrist or other body part. A series of different pads 150*a*–150*g* may also be positioned and measured to determine the overall dampening effects of the pad array and to maximize dampening effects as needed.

For example and with respect to the multitude of different embodiments described with respect to the abovementioned disclosures (and those incorporated by reference herein), the method may involve placing pad 150*a* at a particular location on the palm of the hand 5. A series of bio-feedback sensors 200*a*–200*i* are placed at various positions on the hand 5, wrist 6, thumb 8, elbow 7, and arm 9 to determine the dampening effects of the pad 150*a* at a particular location. It is envisioned that the pad 150*a* may incorporate a sensor (not shown) to determine shock on the actual pad 150*a* and translational forces traveling through the pad 150*a*.

The positioning of each pad 150*a* relevant to the golfer's hand, wrist or thumb, may be mapped to determine the overall dampening effect of the particular pad 150*a* or pads (150*a*–150*g*) and the pad's 150*a* position. A computer interface (not shown) may be employed to map the shock wave and dissipation through the various parts of the hand, wrist, elbow and shoulder. Pad placement, thickness, size, shape are then determined and categorized according to dampening effects on individual body parts, e.g., hand, wrist, elbow, shoulder, etc. As can be appreciated, the ideal pad position for maximum dampening effect for the individual golfer may then be ascertained. It is envisioned that a plurality of pads 150*a*–150*g* may be positioned and utilized in a cooperative manner to maximize impact absorption and overall translation. These pads 150*a*–150*g* may be of the same or different size and shape depending upon a particular purpose.

This step is repeated to determine the various effects that different pad(s) (size, thickness, shape) and the varying positions effect the dampening of the shock waves through the various body parts.

A glove 100 is then constructed in accordance with the particular placement of the pad(s) 150*a*–150*g* to prevent injury or protect the relevant body structures. It is envisioned that a glove 100 may be designed to prevent injury and/or reduce the shock associated with particular ailments. As can be appreciated, different gloves can be tailored for specific injuries. Commercial models may be developed to concentrate on more common injuries which result from common or typical shock translation.

Of course prior to establishing the initial pad position, it may be necessary to establish a shock pattern used as a control reference for determining the effect of the pad (optional step which may be more generalized if it is determined that similar shock patterns are typical with all subjects). This may be particularly true when customizing a glove 100 due to a particular injury as explained herein.

As mentioned above, the pad 150*a*–150*g* itself may also incorporate a bio-feedback mechanism (sensor) 200*a*–200*i* to determine the translation of the shock and the dissipation thereof through the pad 150*a*–150*g* itself. Other embodiments of the pad 150*a*–150*g* and the aforementioned method may employ other sensors 200*a*–200*i* or devices which can measure heat, vibration, initial or impact shock versus dissipation thereof, stress, strain, torque, twist etc. It is envisioned that the pads 150*a*–150*g* may be positioned to reduce one or more of these elements depending upon a particular purpose and/or to reduce/relieve/prevent injury or fatigue. It is also envisioned that the pad(s) 150*a*–150*g* may be designed to cooperate with a thermo-sensitive device (not shown) to apply temperature to specific areas of the hand and wrist as needed to reduce/relieve/prevent injury or fatigue.

From the foregoing and with reference to the various figure drawings, those skilled in the art will appreciate that certain modifications can be made to the present disclosure without departing from the scope of the same. For example, wearing the aforedescribed glove on the non-dominant (traditional side) can also benefit the dominant un-gloved hand, wrist and elbow. This is due to the degree of shock effectively absorbed by the gloved hand which is not translated to the un-gloved hand. Alternatively, the golfer may choose to wear a glove 100 according to the present disclosure on both hands to maximize shock absorption and dissipation.

While several embodiments of the disclosure have been described herein, it is not intended that the disclosure be limited thereto, as it is intended that the disclosure be as broad in scope as the art will allow and that the specification be read likewise. Therefore, the above description should not be construed as limiting, but merely as exemplifications of preferred embodiments. Those skilled in the art will envision other modifications within the scope and spirit of the claims appended hereto.

What is claimed is:

1. A golf glove, comprising:

a glove portion including a finger portion, a thumb portion, a dorsal portion, a palm portion and a wrist portion, said dorsal and palm portions meeting along at least one conjoining lateral edge to define a pocket for receiving the eminence of a golfer's hand; and a pad being dimensioned to at least partially encompass said wrist portion of said glove, said pad being selected from the group consisting of foam, gel, rubber and silicon.

2. The golf glove according to claim 1 wherein said pad includes an elastomeric, non-flowing gel.

3. The golf glove according to claim 1 further comprising a second pad which is dimensioned to substantially cover the palmar side of the hypothenar eminence of the golfer's hand.

4. The golf glove according to claim 1 further comprising a second pad which is dimensioned to at least partially cover the golfer's thumb.

5. The golf glove according to claim 3 wherein said second pad includes an elastomeric, non-flowing gel.

6. The golf glove according to claim 4 wherein said second pad includes an elastomeric, non-flowing gel.

7. The golf glove according to claim 3 wherein said second pad is positioned and dimensioned to substantially cover the palmar portion adjacent the third, fourth and fifth metacarpal bones of the golfer's hand.

8. The golf glove according to claim 1 wherein said pad is positioned and dimensioned to cover the palmar branch of the ulnar nerve and the palmar branch of the median nerve of the golfer's wrist.

* * * * *